US005128876A

United States Patent [19]

Cox

[11] Patent Number: 5,128,876

[45] Date of Patent: Jul. 7, 1992

[54] SYSTEM FOR THE REAL-TIME SCHEDULING AND LOADING OF LOOK-UP TABLES FOR A PATTERNING DEVICE

[75] Inventor: Steven W. Cox, Chesnee, S.C.

[73] Assignee: Milliken Research Corporation, Spartanburg, S.C.

[21] Appl. No.: 487,673

[22] Filed: Mar. 2, 1990

[51] Int. Cl.[5] ..... G06F 15/46

[52] U.S. Cl. ..... 364/470; 364/469; 68/205 R; 118/697; 118/704

[58] Field of Search ..... 364/469, 470; 8/149; 118/676, 697, 704, 698; 68/200, 205 R, 207; 137/624.11, 624.14, 624.15

[56] References Cited

U.S. PATENT DOCUMENTS

| | | | |
|---|---|---|---|
| 3,894,413 | 7/1975 | Johnson | 68/205 R |
| 4,033,154 | 7/1977 | Johnson | 68/205 R |
| 4,116,626 | 9/1978 | Varner | 8/149 |
| 4,170,883 | 10/1979 | Varner | 68/205 R |
| 4,545,086 | 10/1985 | Varner | 8/151 |
| 4,923,743 | 5/1990 | Stewart, Jr. | 427/288 |
| 4,984,169 | 1/1991 | Johnson, Jr. | 364/469 |
| 5,016,308 | 5/1991 | McBride et al. | 8/149 |

*Primary Examiner*—Joseph Ruggiero
*Assistant Examiner*—Paul Gordon
*Attorney, Agent, or Firm*—Kevin M. Kercher; H. William Petry

[57] ABSTRACT

A control system for a patterning device which provides a method for sequentially loading look-up tables, representing pattern conversion values for different patterns to be printed in sequence, into a patterning device in real time. The system also provides a method for reloading a paricular look-up table or group of look-up tables in a prioritized sequence as necessary in order to change the characteristics of the pattern or patterns represented by the table or tables.

11 Claims, 15 Drawing Sheets

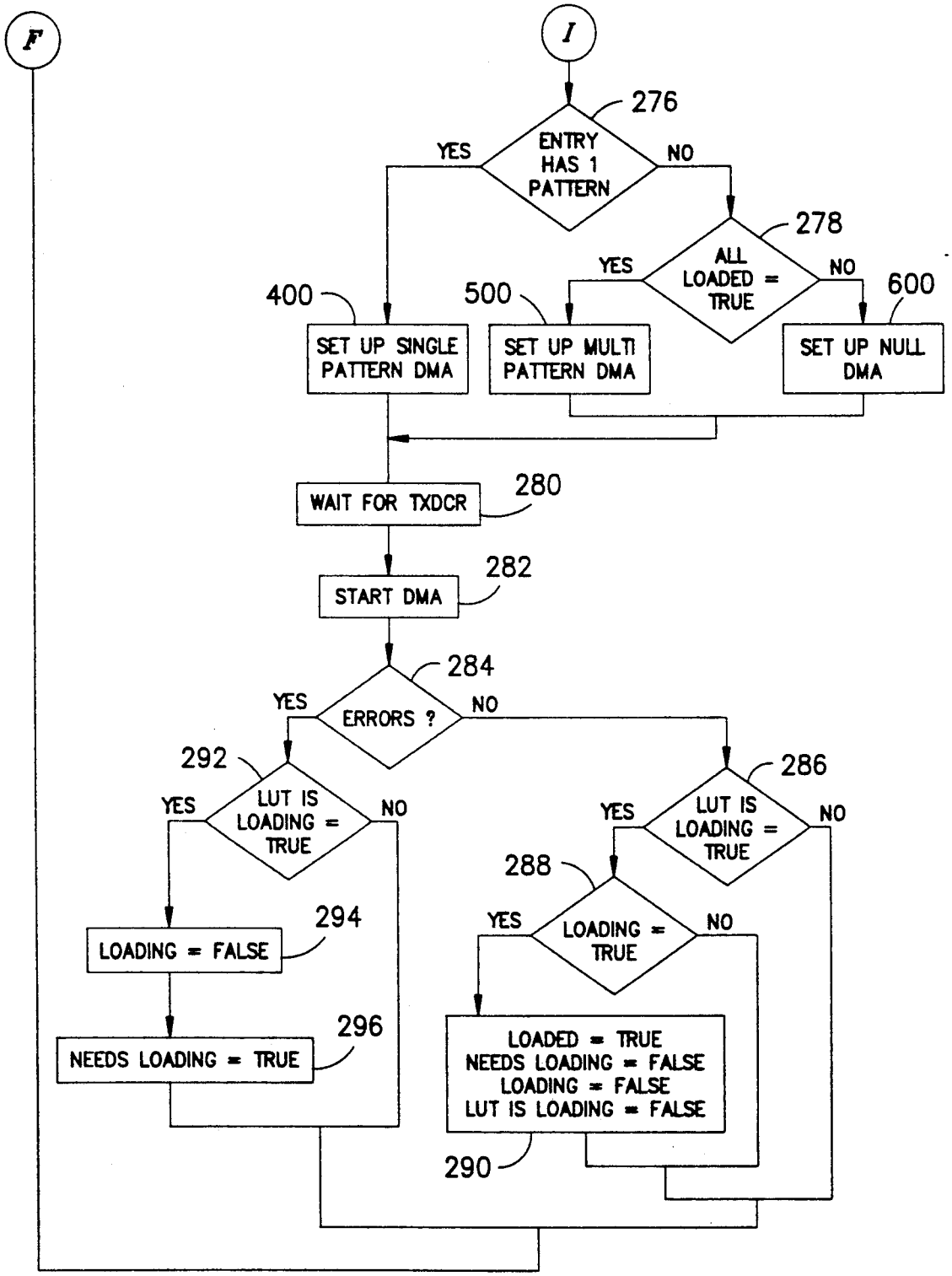
FIG. –10B–

*FIG. –12–*

SYSTEM FOR THE REAL-TIME SCHEDULING AND LOADING OF LOOK-UP TABLES FOR A PATTERNING DEVICE

This invention relates to a control system for an electronic data loading system and, more particularly, to a control system using a programmable direct memory access controller for the real-time loading of look-up tables in the process control portion of a textile patterning system.

The textile patterning system, and the control system disclosed herein, may be used to control the selective application of dyes or other marking materials to a moving substrate in accordance with digitally encoded pattern data. The control system which embodies the invention claimed herein provides for optimizing the placement and replacement of data in a series of look-up tables within which patterning instructions are translated into dye jet firing instructions.

A known modern textile dyeing apparatus includes multiple arrays or color bars, each comprising a plurality of individual, electronically addressable dye jets. Each of the dye jets in a single array outputs the same color of dye. The arrays are positioned in spaced relation across the path of a moving substrate.

Using such apparatus, the pattern-wise application of dye to the textile materials or substrates requires a large quantity of digitally encoded pattern data which must be sorted and routed to each of the individual dye jets comprising each of the arrays. Each of the arrays of dye jets extends across the width of the substrate path as the substrate moves under the arrays. The time period during which the dye streams produced by the individual dye jets in a given array are allowed to strike the substrate are individually controlled.

One such control system capable of providing this capability is described in co-pending U.S. Ser. No. 327,843, entitled "DATA LOADING AND DISTRIBUTING PROCESS AND APPARATUS FOR CONTROL OF A PATTERNING PROCESS", filed on Mar. 23, 1989, the specification of which is hereby incorporated by reference. This system processes pattern data received from a real-time processor through the use of specific electronic circuitry which accepts the pattern data in the form of a series of 8-bit units. Each of the 8-bit units or pixel codes uniquely identifies, for each pattern element or pixel, a pattern design element to be associated with that pattern element or pixel.

The term "pattern element" as used herein is intended to be analogous to the term "pixel" as that term is used in the field of electronic imaging. The number of different pattern design elements is equal to the number of distinct areas of the pattern which may be assigned a separate color.

The term "pattern line" as used herein is intended to describe a continuous line of single pattern elements extending across the substrate, parallel to the patterning arrays. Such pattern lines have a thickness, measured in the direction of substrate travel, equal to the maximum permitted amount of substrate travel under the patterning arrays between array pattern data updates.

In this control system, the pixel codes must first be converted to "on/off" firing instructions, (referring to the actuation or deactuation, respectively, of the individual dye streams produced by the dye jets). This is performed by electronically associating the "raw" pixel codes with pre-generated firing instruction data from a computer generated look-up table, the loading of which comprises the subject matter of the instant invention. The pixel codes merely define those distinct areas of the pattern which may be assigned a distinguishing color. Each code specifies, for each pattern line, the dye jet response for a given dye jet position on each and every array. In this system the number of arrays equal eight; therefore, each pixel code controls the response of eight separate dye jets (one per array) with respect to a single pattern line.

The pixel codes for a given array is preferably arranged in sequence, with data for dye jets 1–N for the first pattern line being first in he series, followed by data for dye jets 1–N for the second pattern line, etc. The complete serial stream of such pixel codes is sent to a firing time converter and memory associated with each respective array for conversion of the pixel codes into the respective firing times.

Each firing time converter includes a look-up table having a sufficient number of addresses so that each possible address code forming the serial stream of pattern data may be assigned a unique address in the look-up table. At each address within the look-up table is a byte representing a relative firing time or dye contact time, which, assuming an 8-bit value at the address code of interest, can be zero or one of 255 different discreet time values corresponding to the relative amount of time the dye jet in question is to remain "on". Therefore, each specific dye jet location on each and every array can be assigned one of 256 different firing times. The management of generating, loading, checking, and replacing the data associated with this look-up table function comprises the subject matter of the invention disclosed herein.

The firing time data from the look-up table for each array is then further processed to account for the "stagger", e.g., the physical spacing between arrays, and the allocation of the individual firing instructions for each jet in the array. The process of sequencing the individual pattern line data to accommodate substrate travel time or stagger between adjacent arrays is performed through the use of array-specific Random Access Memories (RAMs), which are preferably of the static type. All pattern data for a specific array is loaded into a RAM individually associated with that array. The pattern data is in the form of a series of bytes, each byte specifying a desired firing time for a single applicator or jet comprising the array. The loading process is a coordinated one, with all jet firing time data being loaded into the respective RAMS at the same time and in the same relative order, i.e., all firing times corresponding to the first line of the pattern for all jets in each array is loaded in the appropriate RAM first, followed by all data corresponding tot he second pattern line, etc. Each RAM is read using reading address offsets which effectively delay the reading of the data a sufficient amount of time to allow a specific area of the substrate to "catch up" to the corresponding pattern data for that specific area which will be sent to the next array along the substrate path.

At this time, the series of individual firing times expressed in byte form are transferred into a sequence of individual binary digit ("bit") groups. Each group in the sequence represents the value of its corresponding respective firing time by the relative number of binary digits of a predetermined logic value (e.g., logical "one"="fire") which are sequentially "stacked" within each group. This transformation allows the firing times, expressed in byte form, to be expressed as a continuing sequence of individual firing commands (i.e., single bits) which may be recognized by the applicators.

Finally, the individual firing instructions for each jet in the array are loaded into a collection of First-In First-Out Memories (FIFOs). Each array is associated with an individual set of FIFOs. Each FIFO repeatedly sends its contents, one byte at a time and strictly in the order in which the bytes were originally loaded, to a comparator. The value of the byte, representing a desired elapsed firing time of a single jet along the array, is compared with a clock value which has been initialized to provide a value representing the smallest increment of time for which control of any jet is desired. As a result of the comparison, a firing command in the form of a logical "one"or logical "zero", which signifies that the jet is to "fire" or "not fire", respectively, is generated and is forwarded to a shift register associated with the array, as well as to a detector.

After all bytes (representing all jet locations along that array) have been sent and compared, the contents of the shift register are forwarded, in parallel, to the air valve assemblies along the array by way of a latch associated with the shift register. Thereafter, the counter value is incremented, the same contents of the FIFO are compared with the new counter value, and the contents of the shift register are again forwarded, in a parallel format and via a latch, to the air valve assemblies in the array.

At some counter value, all elapsed firing times read from the FIFOs will be less than or equal to that value of the counter. When this condition exists at every array, fresh data, representing a new pattern line, is forwarded from the RAM in response to a transducer pulse indicating the substrate has moved an amount equivalent to one pattern line. This fresh data is loaded into the FIFOs and a new series of iterative comparisons is initiated, using a re-initialized counter. This process is repeated until all pattern lines have been processed. If the pattern is to be repeated, the RAM re-initiates the above procedure by sending the first pattern line to the appropriate FIFO's.

The pattern data for each different pattern must be translated into characteristic firing times. This requires the loading of firing time data into a look-up table each time the pattern being run on the patterning machine is changed. The pattern is changed each time a separate print job is loaded into the patterning machine. Each individual print job may require the printing of a single pattern or many different patterns as a part of that particular job. Accordingly, each time a new print job is loaded into the patterning machine, new firing time data must be loaded into a look-up table, even if one or more of the patterns comprising the new print job are the same as patterns comprising the current print job.

The software system described hereinbelow provides for the sequential execution of individual print jobs (and the associated loading of the look-up tables with new data) with a minimum of unintended, unprinted substrate separating each job or individual repeats within a given print job.

Each pattern in each print job has associated with it a look-up table which, for each pattern element, defines (sequentially) a dye jet firing time for each dye jet in each array. The look-up table must be loaded into the memory associated with each color bar prior to the time all jets in that color bar are required to be actuated. All look-up tables for all patterns in a given print job must be loaded prior to running that print job. Due to the quantity of data contained in the look-up tables and the speed at which the substrate to be patterned is moving past the dye jets on the color bar, only one look-up table can be loaded per line of pattern data. Therefore, for jobs containing only one pattern, the look-up table for that pattern can be loaded on the first line of data for that pattern. However, for jobs containing more than one pattern, it is necessary to load the look-up tables prior to the time the first line of pattern data needs to be outputted to the dye jets on the respective color bars.

The software control system described below not only allows the pre-loading of look-up tables, but provides for such pre-loading at the same time the substrate is being patterned with the pattern(s) comprising a previous Entry. This eliminates the problem of wasting substrate because the proper look-up tables were not loaded into the patterning system in a timely manner.

An additional benefit of the software control system described herein is the ability of the instant system to accommodate intentional changes in firing time values (e.g., to compensate for different dye absorption characteristics found in various substrates) when those changes are made while the patterning machine disclosed above is patterning, without having to stop the machine or producing imperfectly patterned substrate as a result of an inability to adjust look-up table values.

Additional features and benefits of the software system disclosed herein will be apparent in light of the detailed discussion which follows, when read in conjunction with the accompanying Figures, in which.

Figure 5:
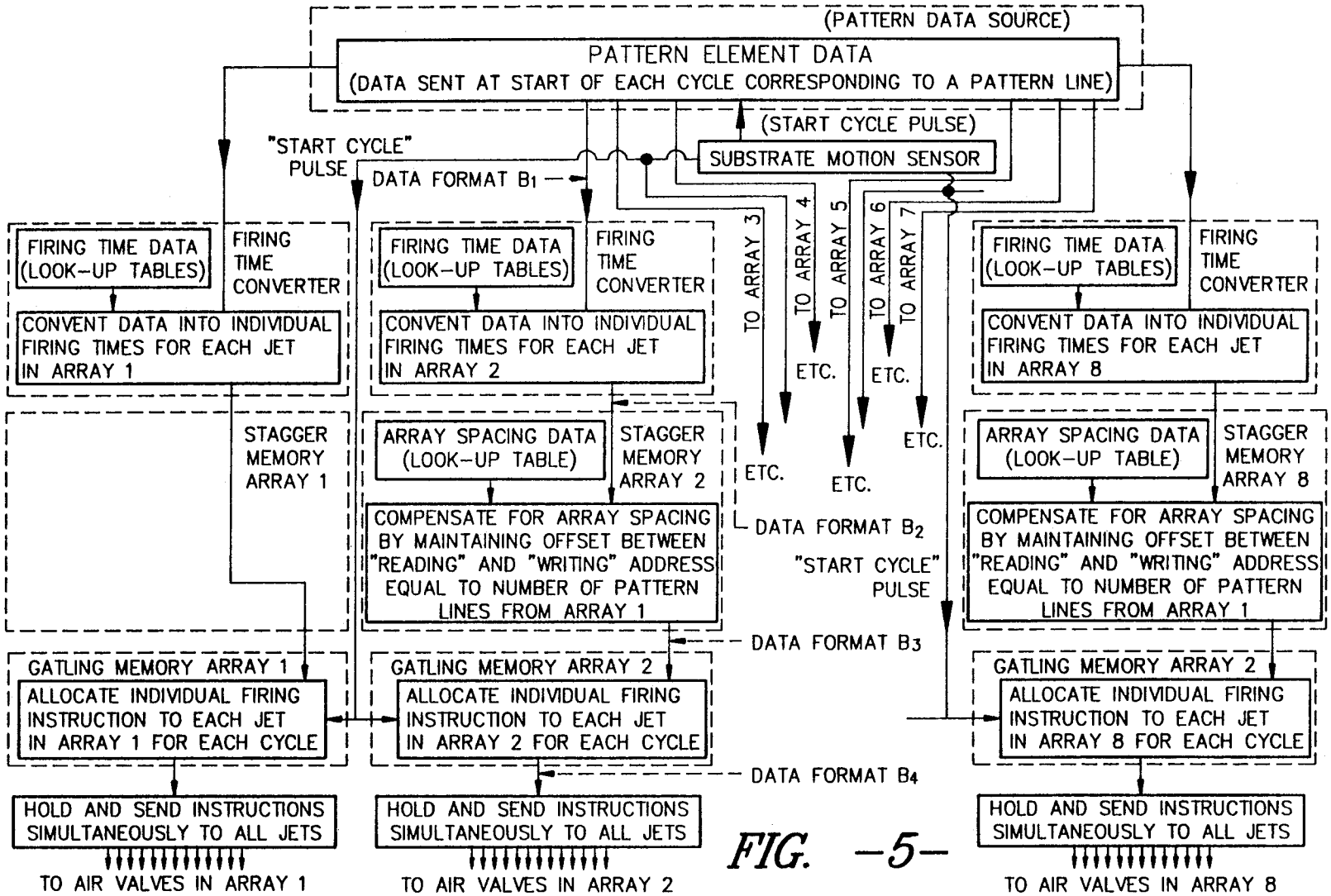
FIG. 5 is a block diagram further disclosing the control system of the apparatus.
Figure 6A:
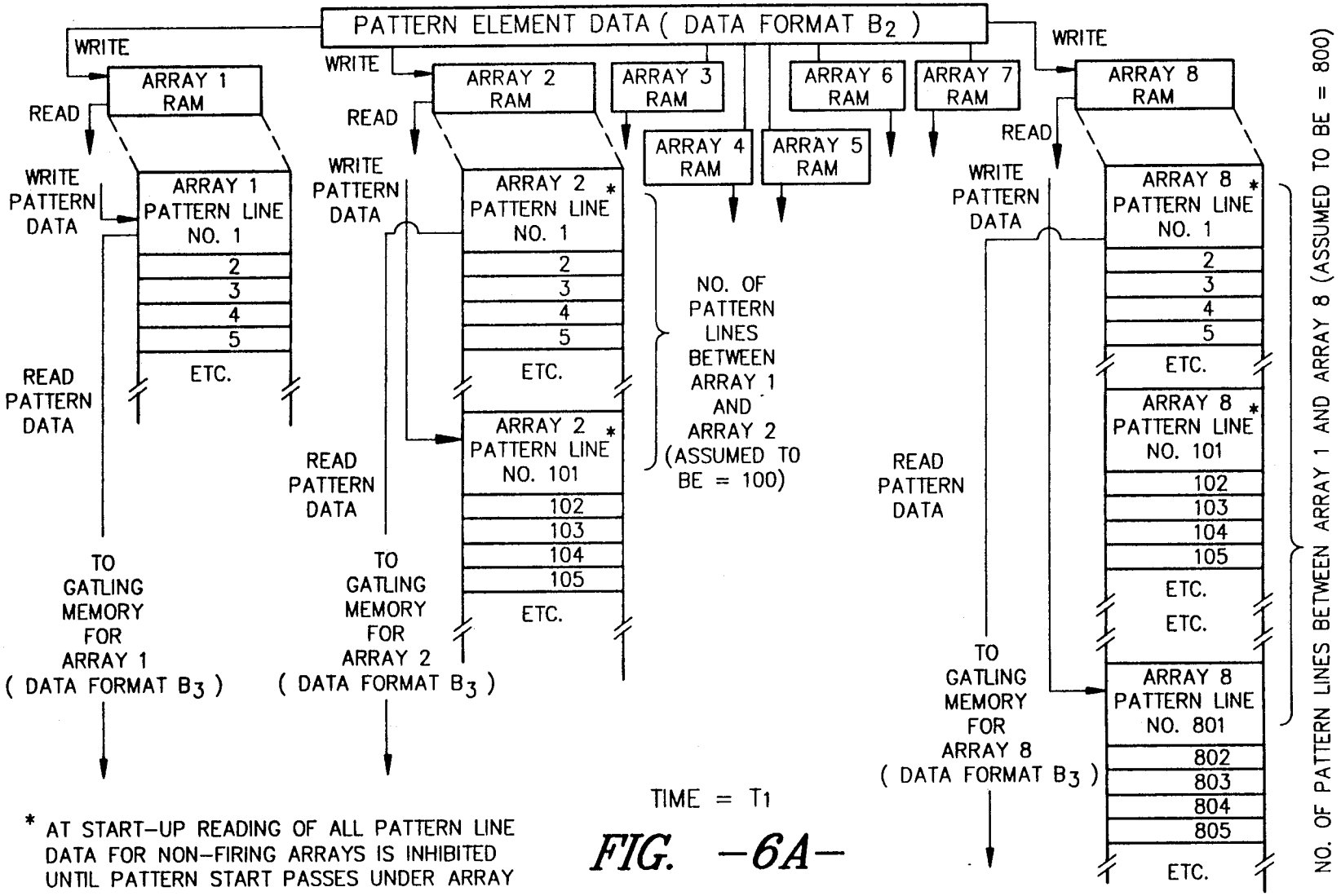
Figure 6B:
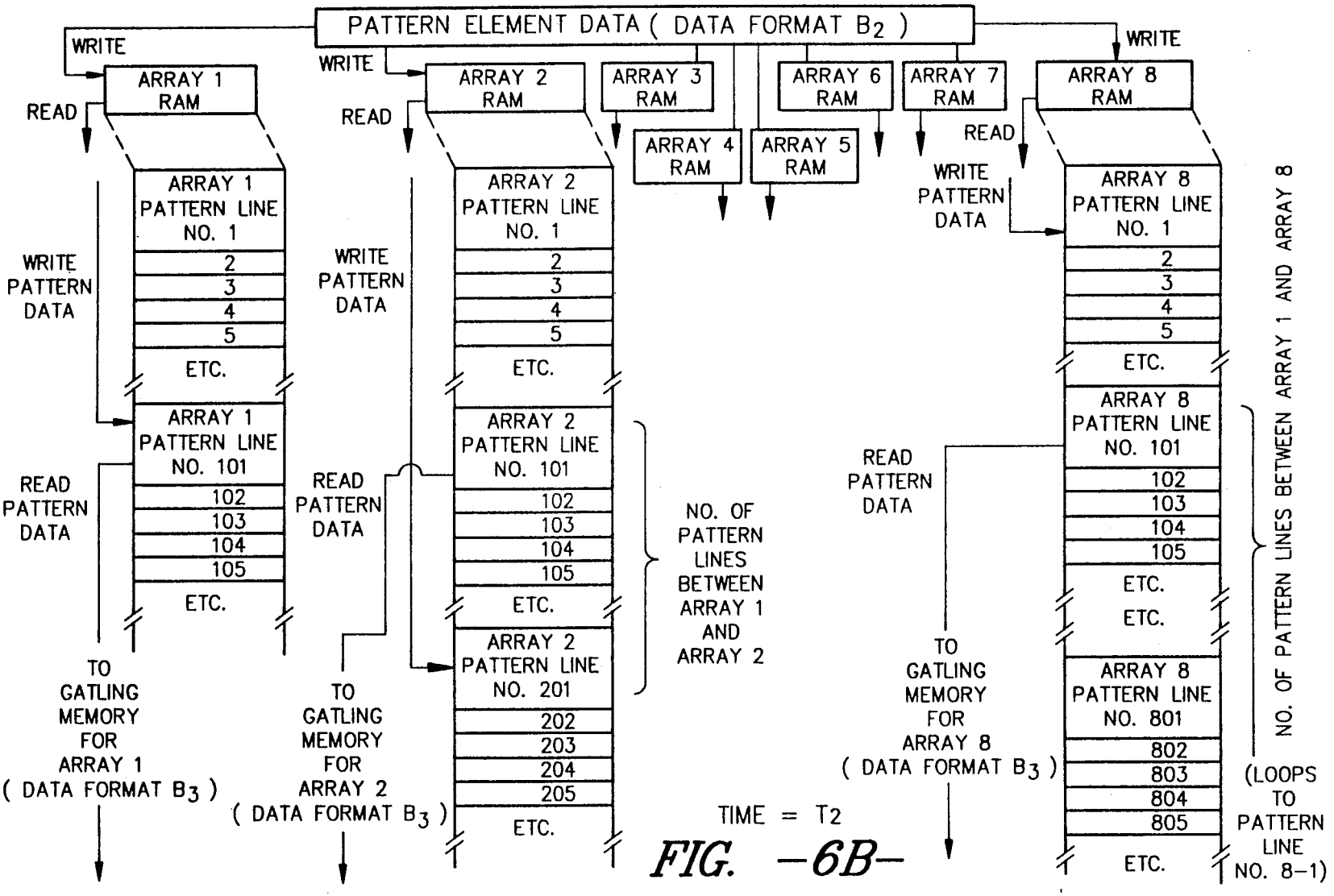
Figure 7:
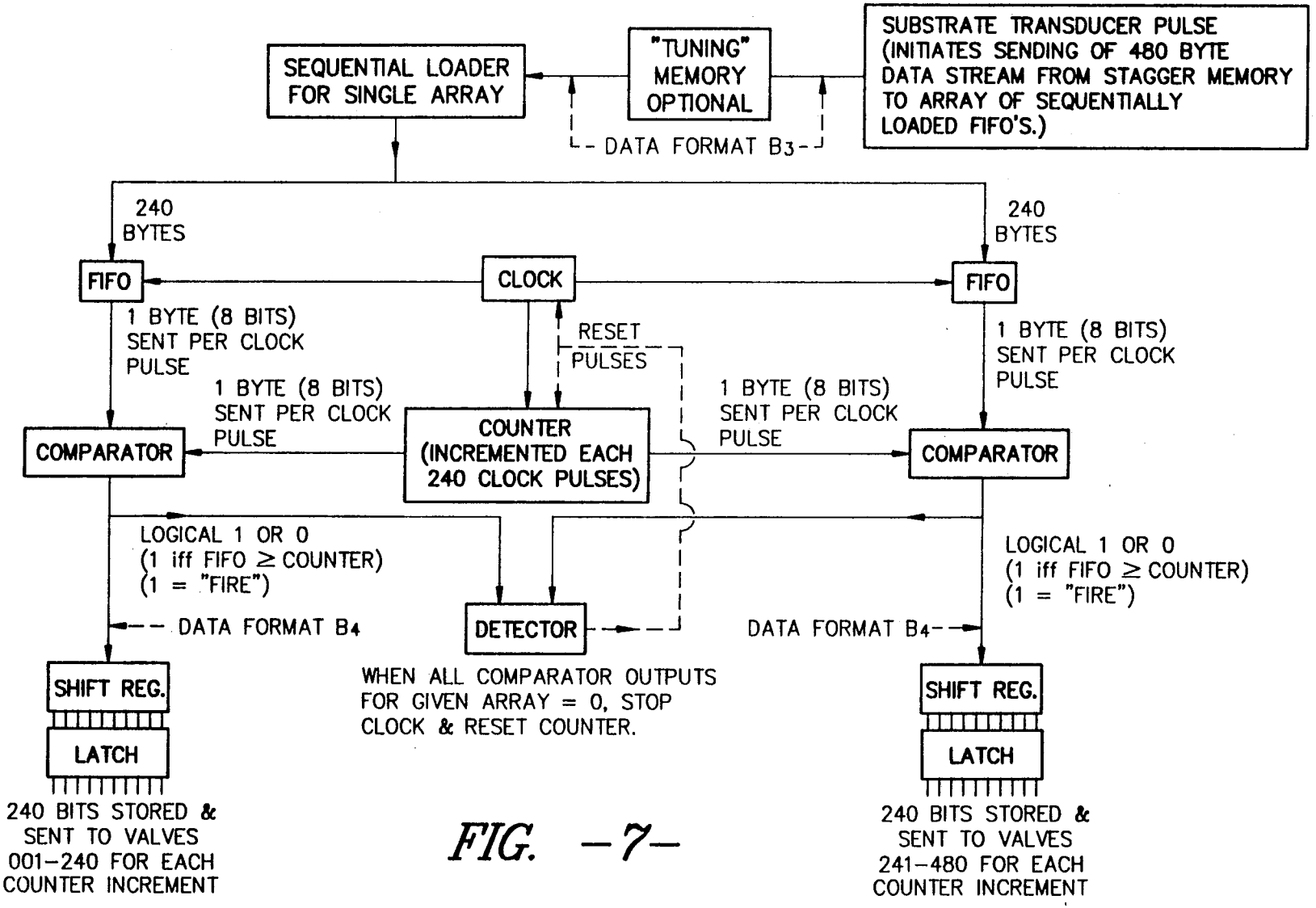
Figure 8:
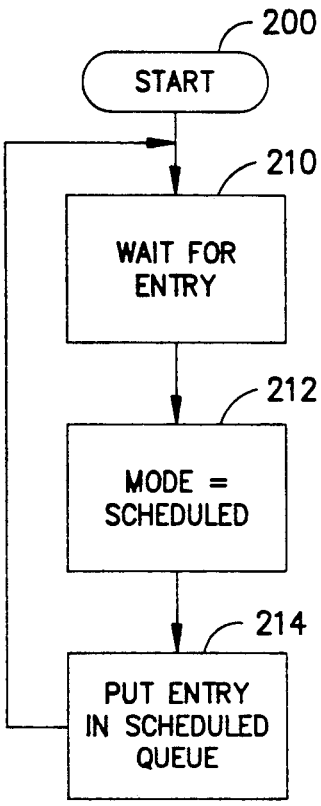
Figure 9:
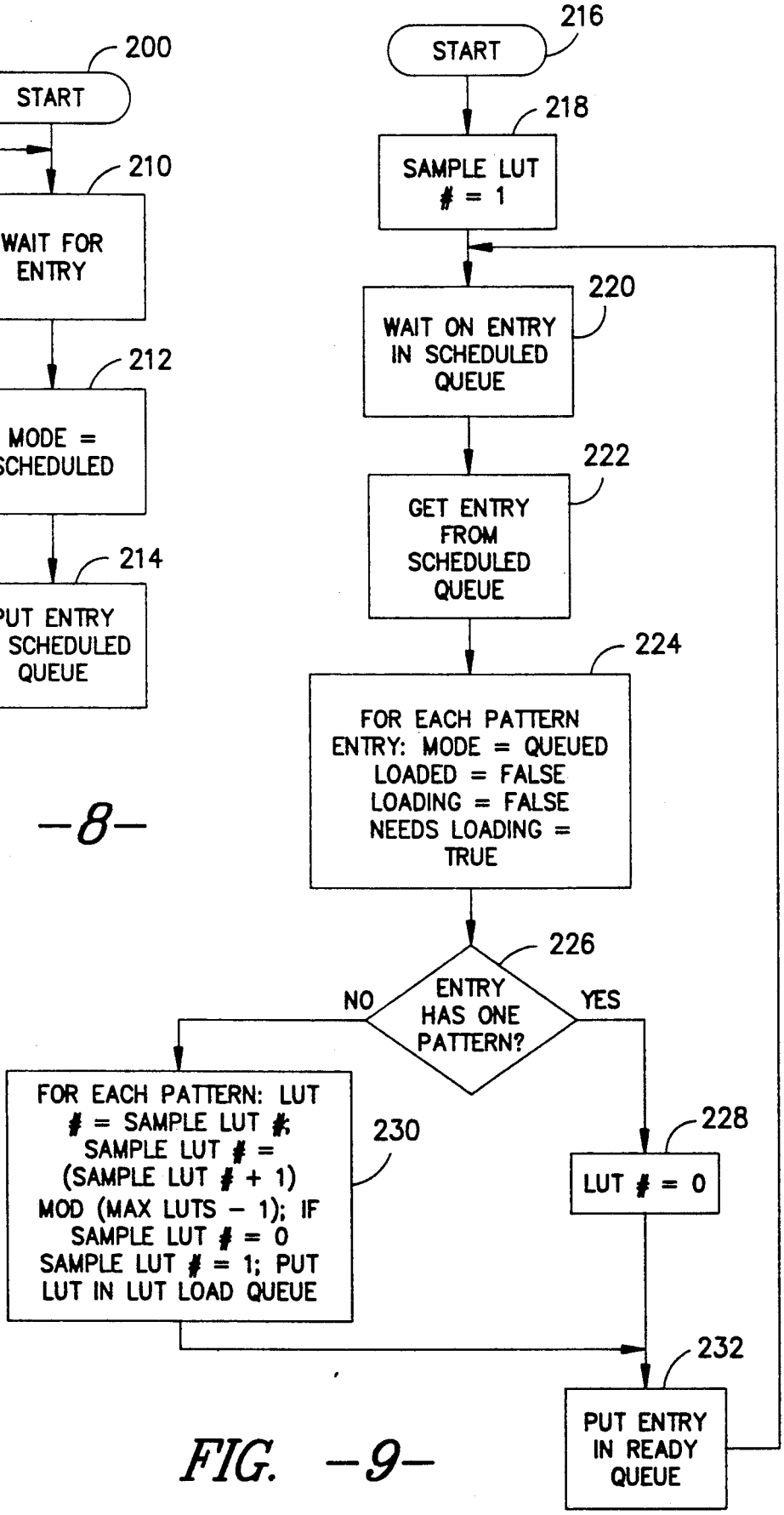
Figure 10A:
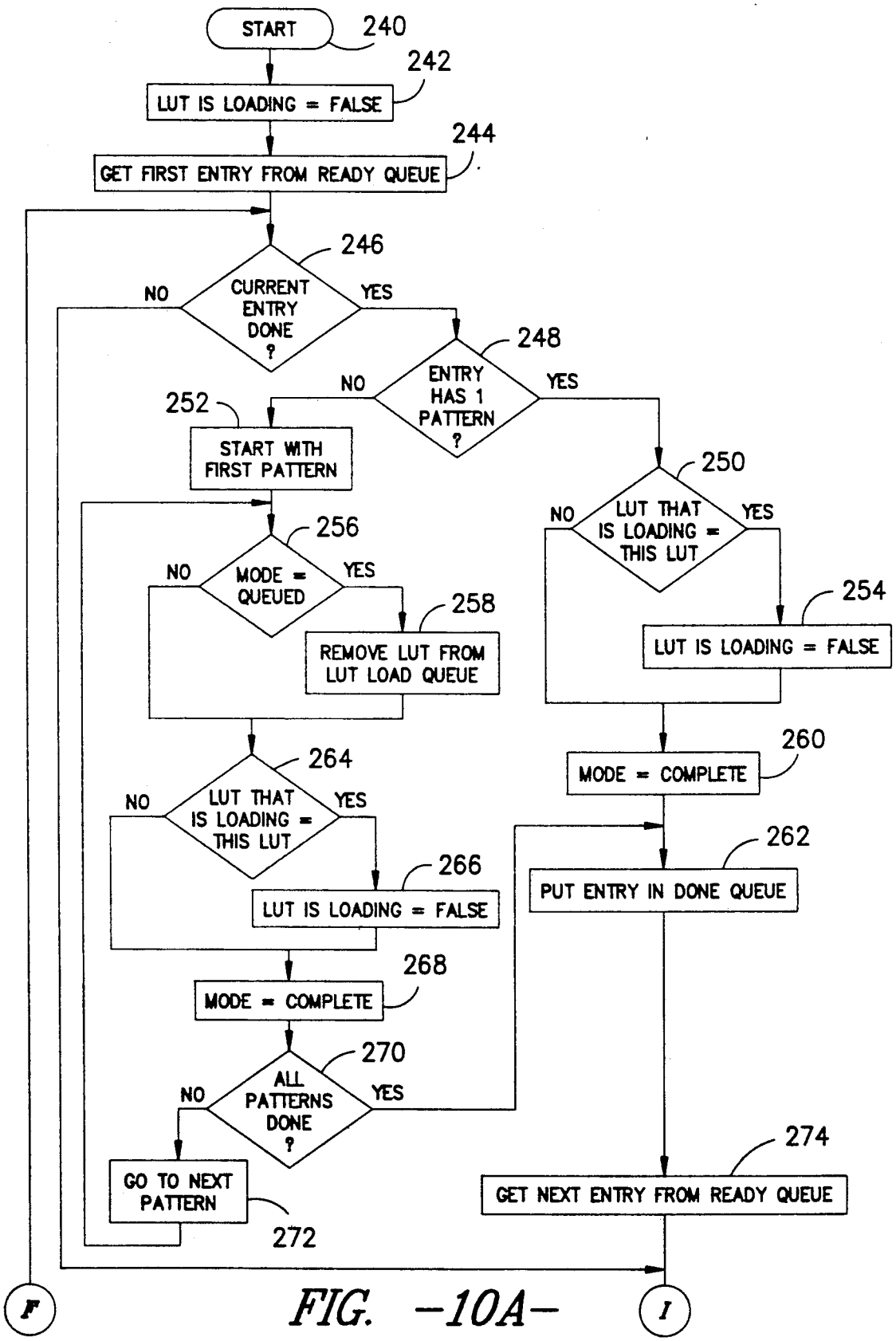
Figure 11:
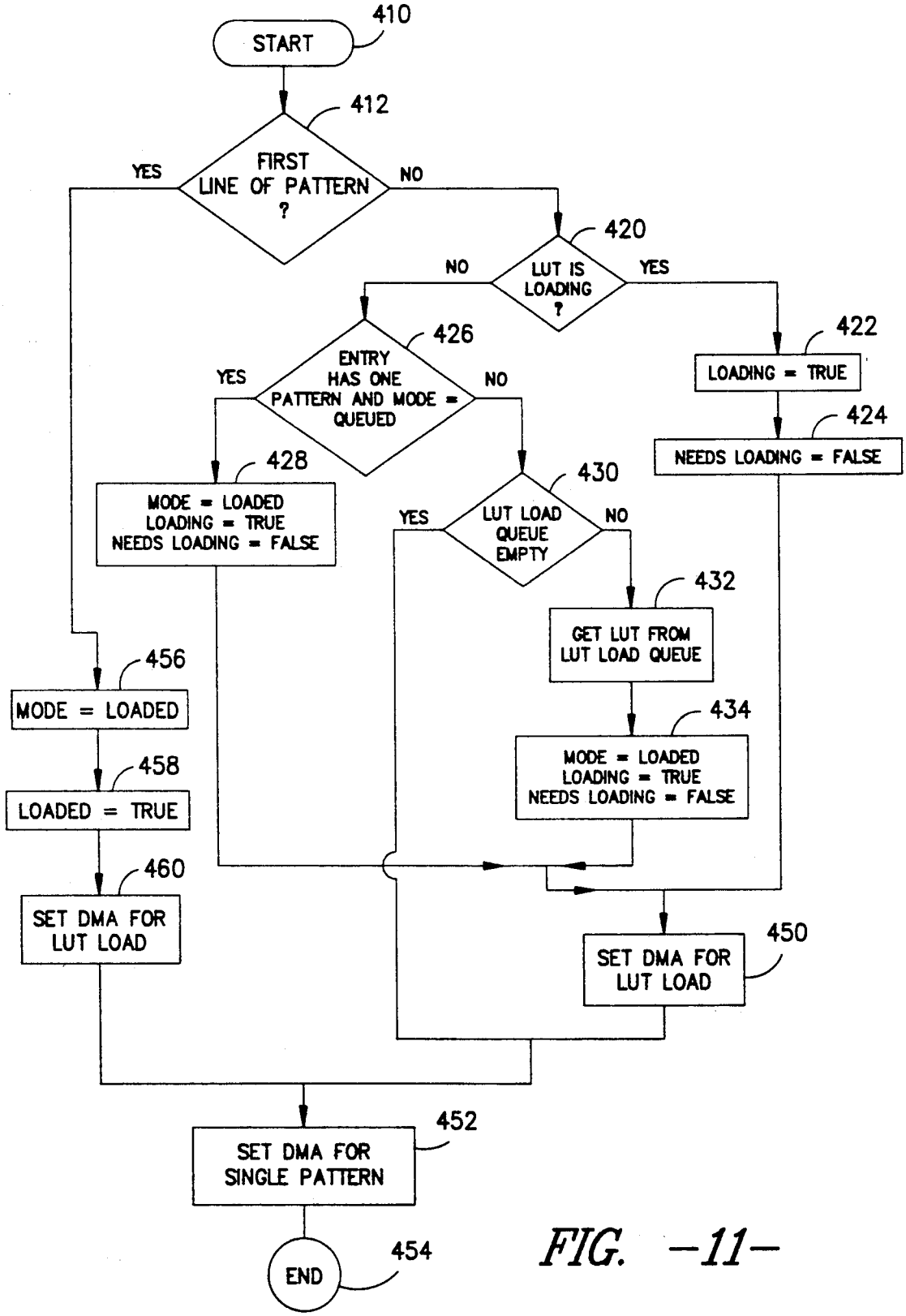
Figure 12:
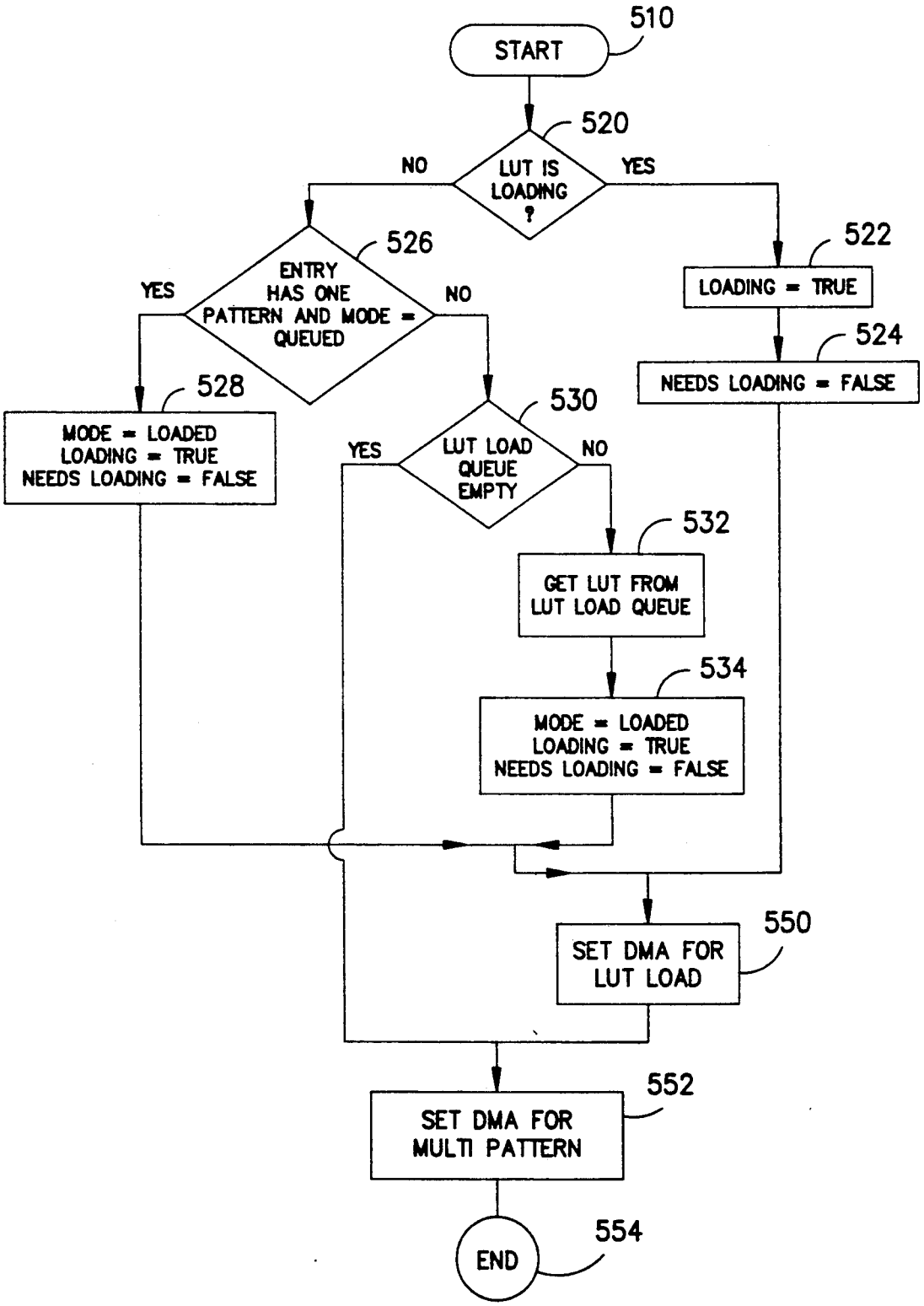
Figure 13:
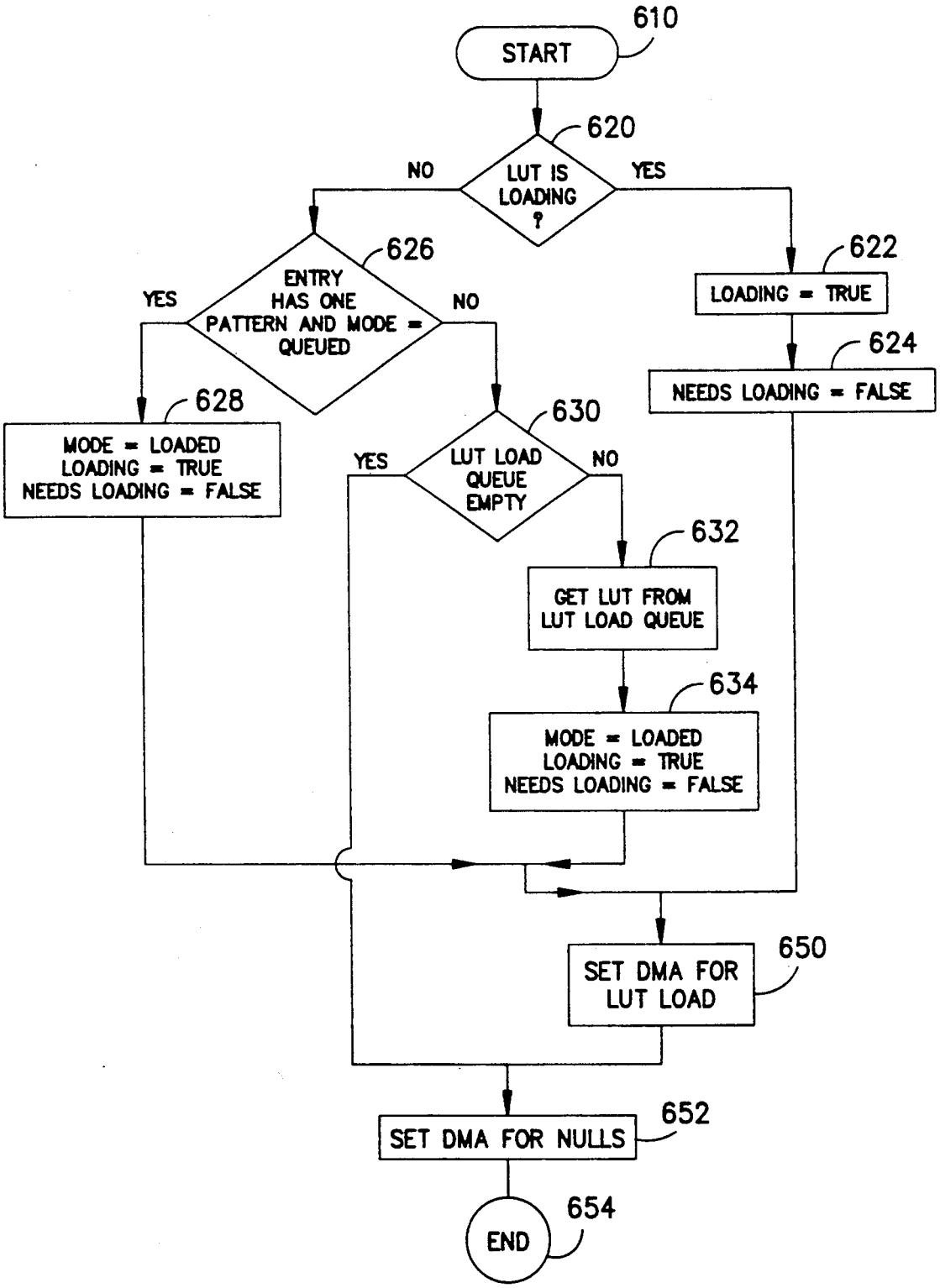
Figure 14:
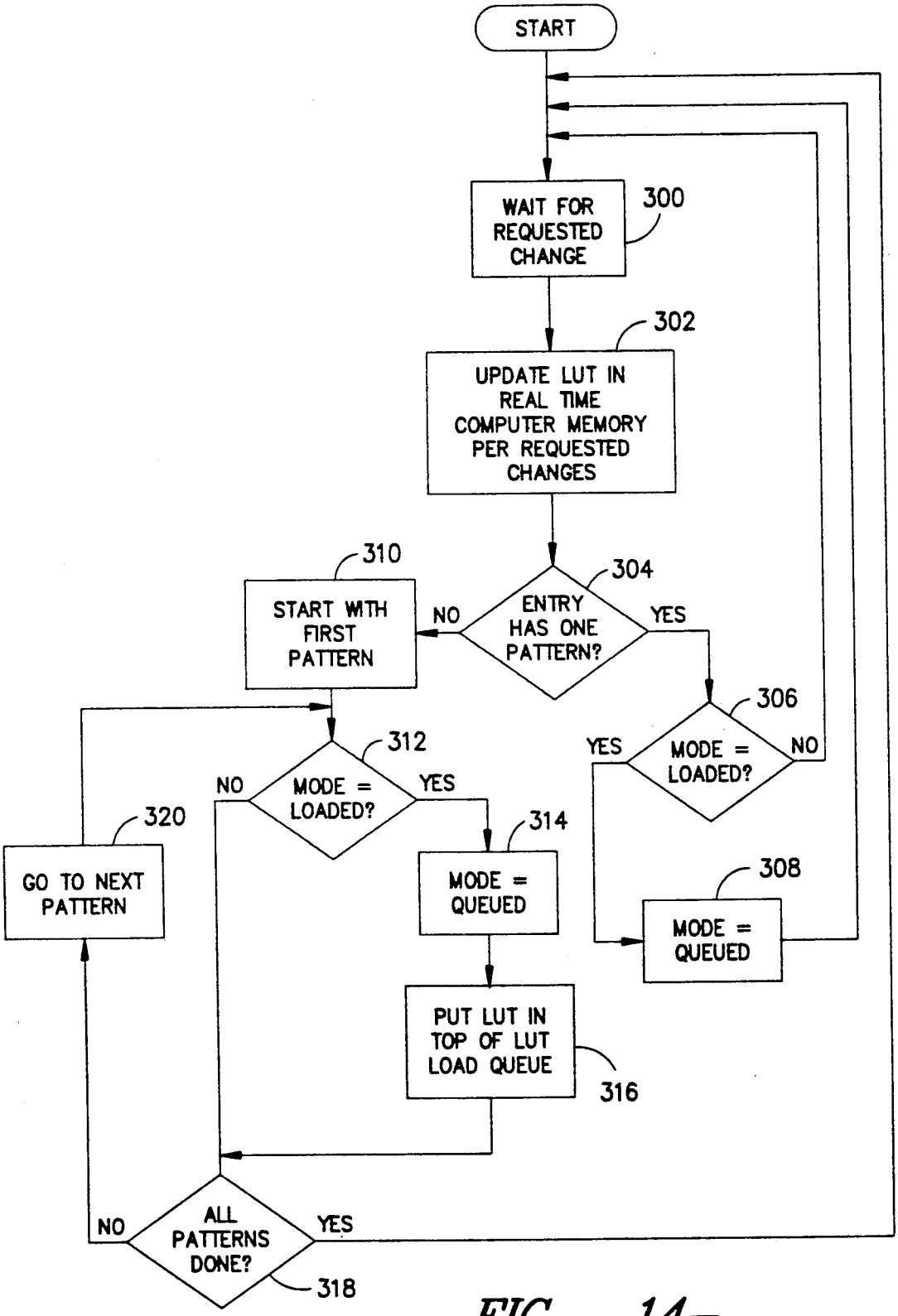

FIGS. 6A and 6B are diagrammatic representations of the "stagger" memory disclosed in FIG. 5. FIG. 6A depicts a memory state at a time T1; FIG. 6B depicts a memory state at time T2, exactly 100 pattern lines later;

FIG. 7 is block diagram describing the "gatling" memory described in FIG. 5;

FIG. 8 is a flow chart describing the ADD ENTRY TO RUN LIST process discussed herein;

FIG. 9 is a flow chart describing the PREPARE ENTRY FOR RUNNING process discussed herein;

FIGS. 10A and 10B are flow charts describing the TRANSDUCER process discussed herein;

FIG. 11 is a flow chart describing the SET UP MULTI PATTERN DMA portion of the TRANSDUCER process described herein;

FIG. 12 is a flow chart describing the SET UP NULL DMA portion of the TRANSDUCER process described herein;

FIG. 13 is a flow chart describing the SET UP SINGLE PATTERN DMA portion of the TRANSDUCER process described herein; and FIG. 14 is a flow chart describing the CHANGE FIRING TIME process described herein.

Figure 1:
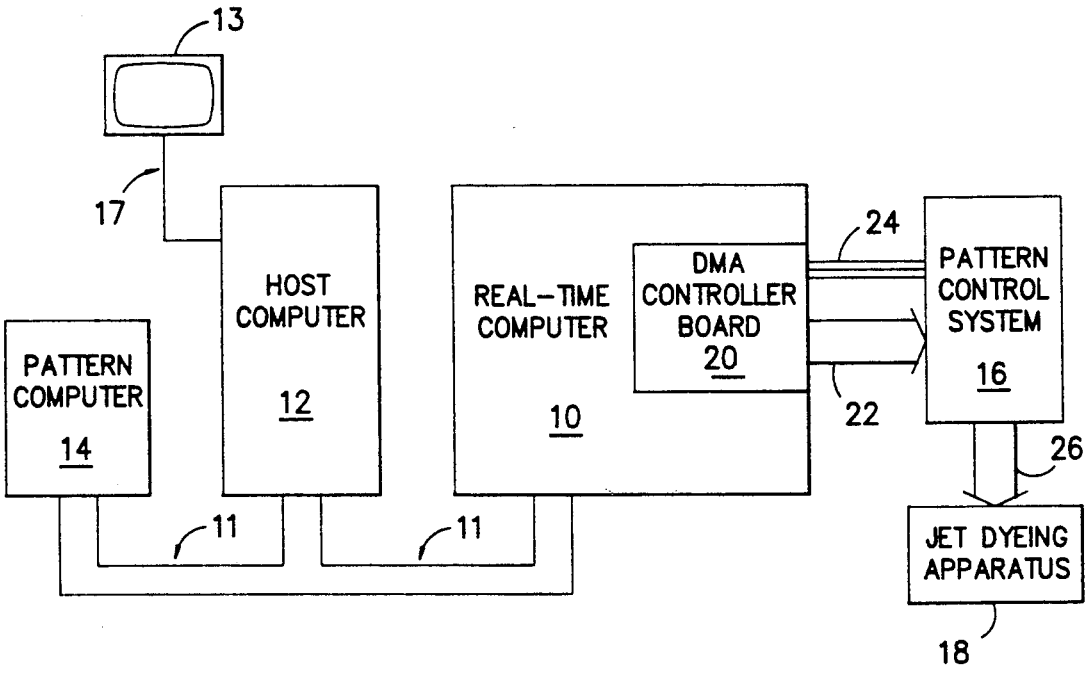
FIG. 1 is a block diagram illustrating one pattern control system environment in which the present invention may operate.

Referring to FIG. 1, a multiprocessor patterning system 5 is shown having a host computer 12 coupled via a bus 11 to a real-time computer 10. Optional pattern computer 14 is further coupled to the host computer 12 and real-time computer 10 by the bus 11. It is readily apparent that the coupling of the pattern computer 14, host computer 12 and real-time computer 10 may be by any means for coupling a local area network (LAN) such as an Ethernet bus.

A pattern control system 16 is coupled via bus 26 to a jet dyeing apparatus 18. The jet dyeing apparatus 18 is described in greater detail in FIGS. 2 and 3. The pattern control system 16 receives inputs from bus 22 and channel select lines 24 of the programmable DMA controller board 20. The programmable DMA controller board 20 is part of the real-time computer 10 and is described in greater detail in FIG. 2.

Optional pattern computer 14 may be provided to allow a user of the system to quickly create their own pattern design. Alternatively, pattern designs may be pre-loaded onto magnetic or optical media (not shown) for reading into the system. A computer terminal 13 may be coupled via a suitable connection 17, e.g., a standard RS232 cable, to the host computer 12. The terminal 13 then serves as the operator's interface for providing the input parameters to the host computer for each "job" of patterns to be generated on the substrate by jet dyeing apparatus 18. The host computer 12 also fetches the pattern data from he pattern computer or other source and sets it up for processing by the real-time computer 10. The real-time computer 10 functions to insure that the pattern data is properly output to the pattern control system 16 by programming appropriately the DMA controller board 20.

Figure 2:
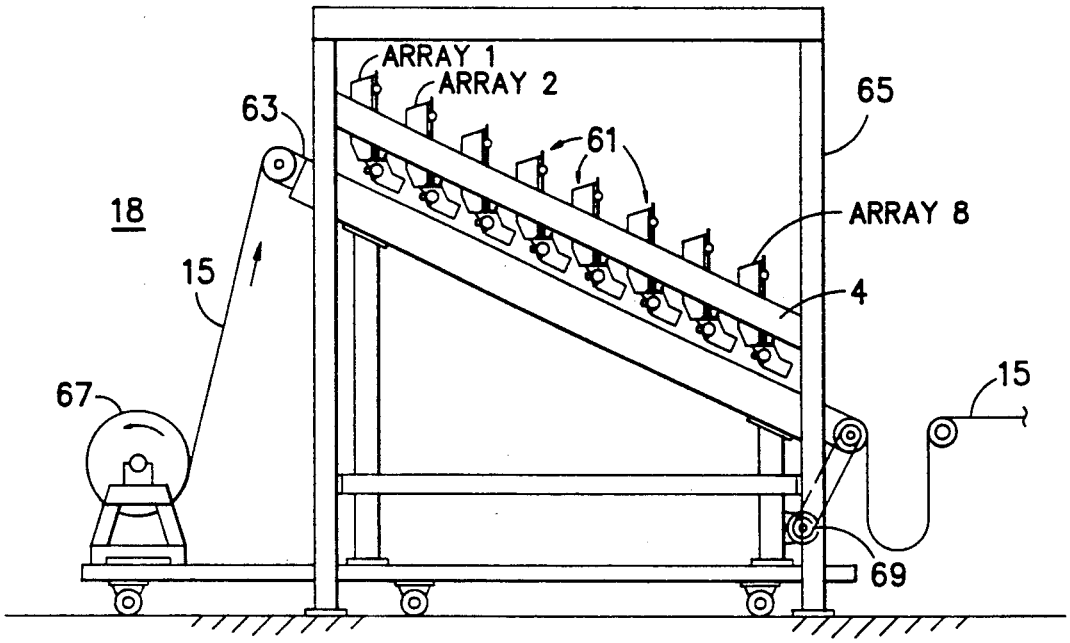
FIG. 2 is a diagrammatic side elevation view of a jet dyeing apparatus to which the present invention is particularly well adapted.

FIG. 2 shows a jet dyeing apparatus 18 comprised of a set of eight individual color bars 61 positioned within frame 65. Each color bar 61 is comprised of a plurality of dye jets, perhaps several hundred in number, arranged in spaced alignment along the length of the color bar, which color bar extends across the width of substrate 15. Substrate 15, such as a textile fabric, is supplied from roll 67 as transported through frame 65 and thereby under each color bar 61 by conveyor 63 driven by a motor indicated generally at 69. After being transported under color bars 61, substrate 15 may be passed through other dyeing-related color steps such as drying, fixing, etc.

Figure 3:
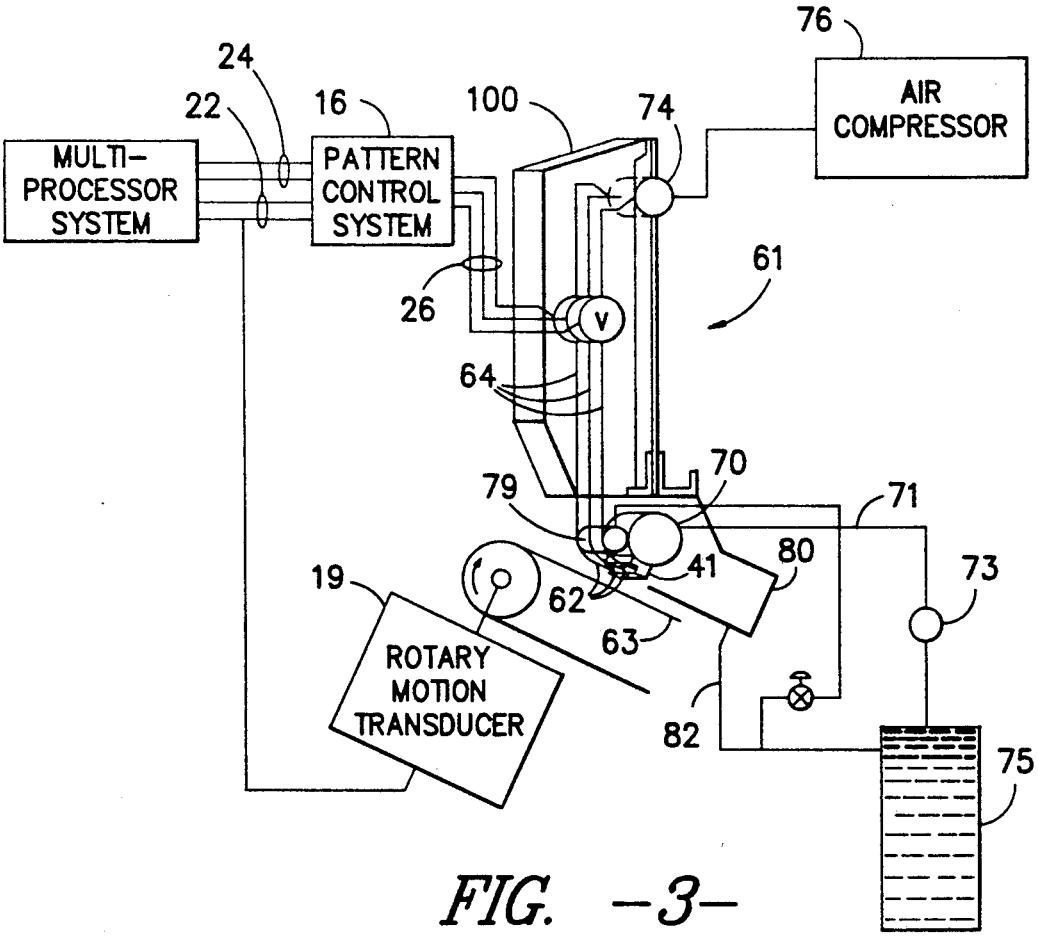
FIG. 3 is a schematic side elevation view of the apparatus of FIG. 2, showing only a single dye jet color bar and its operative connection to a liquid dye system, as well as several electronic subsystems associated with the apparatus.

Referring to FIG. 3, there is shown in schematic form a side elevation of one color bar 61 comprising the jet dyeing apparatus 18 of FIG. 2. For each such color bar 61, a separate dye reservoir tank 75 supplies liquid dye under pressure by means of pump 73 and dye supply conduit means 71, to a primary dye manifold assembly 70 of the color bar 61. Primary manifold assembly 70 communicates with and supplies dye to dye sub-manifold assembly 41 at suitable locations along their respective lengths. Both manifold assembly 70 and sub-manifold assembly 41 extend across the width of conveyor 63 on which the substrate to be dyed is transported. Sub-manifold assembly 41 is provided with a plurality of spaced, generally downwardly directed dye passage outlets positioned across the width of conveyor 63 which produce a plurality of parallel dye streams which are directed onto the substrate surface to be patterned.

Positioned in alignment with and approximately perpendicular to each dye passage outlet (not shown) in sub-manifold assembly 41 is the outlet of an air deflection tube 62. Each tube 62 communicates by way of an air deflection conduit 64 with an individual electro-pneumatic valve, illustrated collectively at "V", which valve selectively interrupts the flow of air to air tube 62 in accordance with the pattern information supplied by pattern control system 16. Each valve is, in turn, connected by an air supply conduit to a pressurized air supply manifold 74 which is provided with pressurized air by air compressor 76. Each of the valves V, which may be, for example, of the electromagnetic solenoid type, are individually controlled by electrical signals received over bus 26 from the electronic pattern control system 16. The outlets of deflection tubes 62 direct streams of air which are aligned with and impinge against the continuously flowing streams of dye flowing from downwardly directed dye passages within sub-manifold 41 and deflect such streams into a primary collection chamber or trough 80, from which liquid dye is removed, by means of a suitable dye collection conduit 82, to dye reservoir tank 75 for recirculation.

The pattern control system 16 receives pattern data over bus 22 and control information over lines 24 from the multiprocessor system described in FIG. 1. The desired pattern information from control system 16 is transmitted to the solenoid valves of each color bar 61 at appropriate times in response to movement of the substrate under the color bars by conveyor 63, which movement is detected by a suitable rotary motion sensor or transducer means 19 operatively associated with the conveyor 63 and connected to control system 16.

Figure 4A:
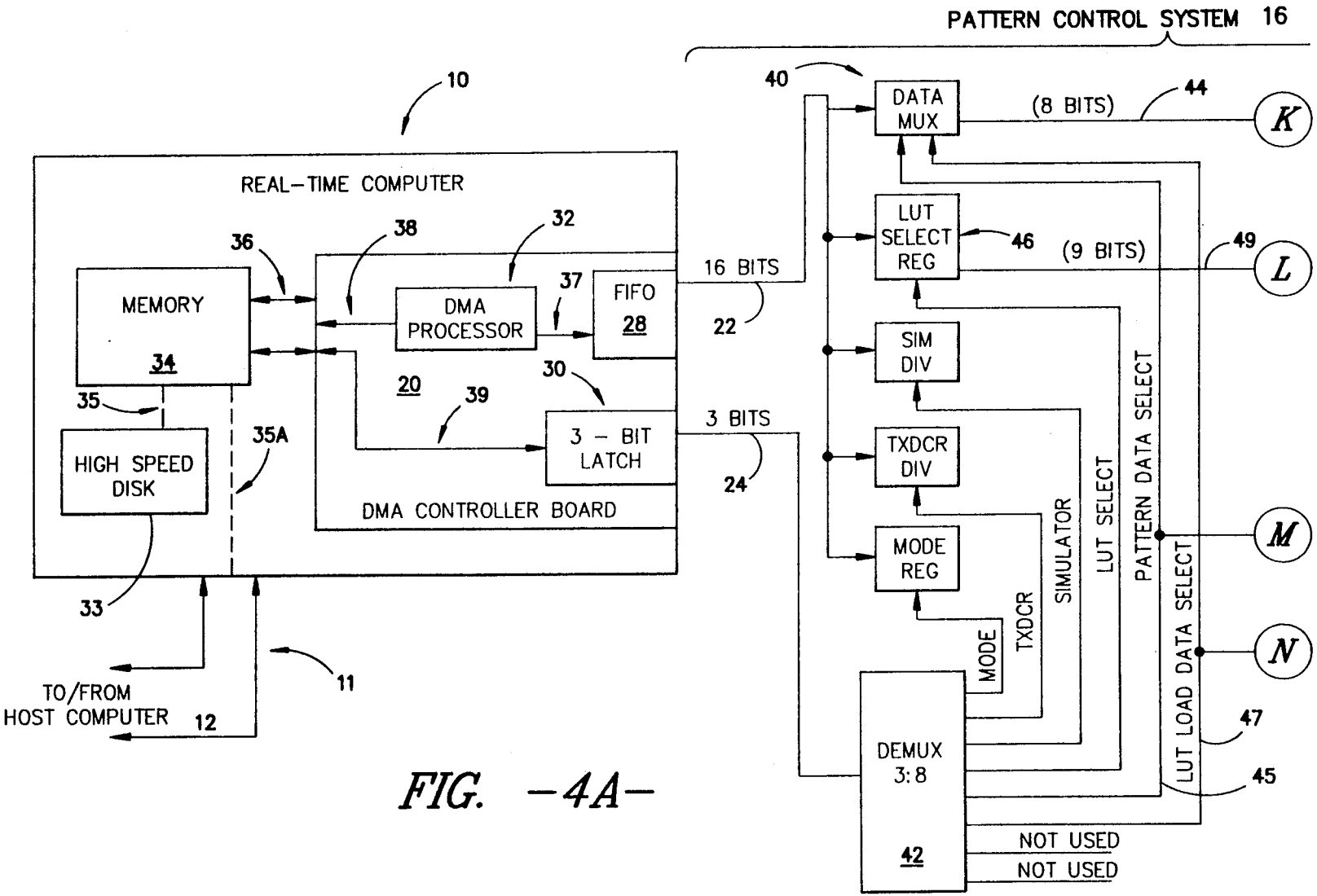
FIGS. 4A and 4B are a schematic block diagram illustrating in greater detail the real-time computer and pattern control system of FIG. 1.
Figure 4B:
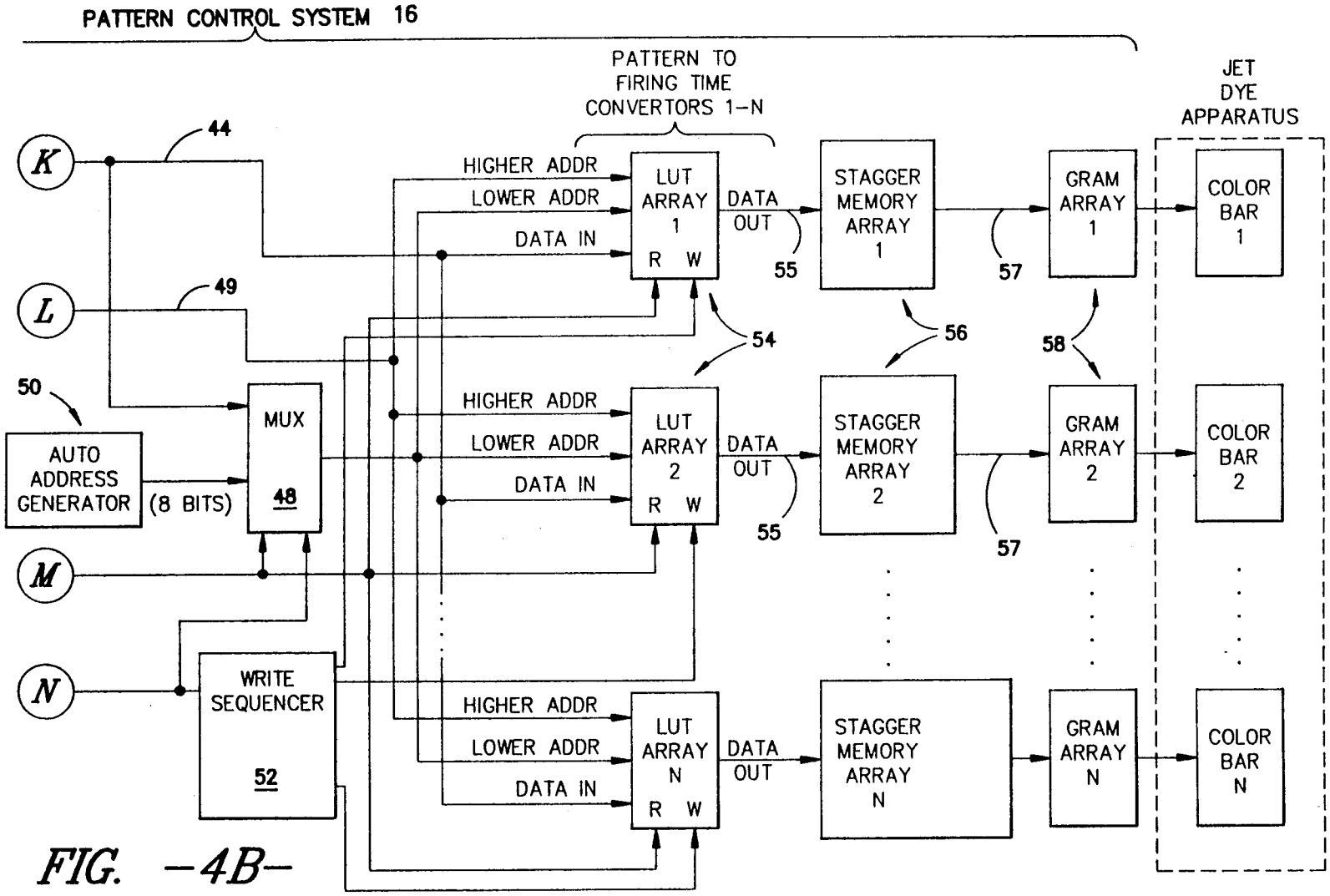

Referring to FIG. 4, the real-time computer 10 is shown having memory 34 and programmable DMA controller board 20. Pattern data is received from the host computer 12 via the bus 11 and stored on high speed disk 33 by way of diagrammatically depicted links 35 and 35A, which typically may be comprised of an I/O bus, associated bus interface units, and an appropriate network interface unit, not shown. As appropriate, data is moved from high speed disk 33 into memory 34, via link 35, for access by DMA controller 20 via bus 36.

The programmable DMA controller board 20 is shown comprising a programmable DMA processor 32, FIFO buffer 28 and 3-bit latch 30. The programmable DMA processor 32 couples with bus 36 via line 38 and with FIFO buffer 28 via line 37. Further, the 3-bit latch 30 is coupled to the bus 36 via line 39. It should be understood that FIG. 4 shows only a simplified diagrammatically depicted version of the programmable DMA controller board 20. A more complete and accurate description of the controller board 20 can be found by consulting the specifications thereof; for example, the controller board 20 may be of the type produced by Digital Equipment Corporation as Model DRQ3B or may be the Intel 82258 DMA chip used in conjunction with a host computer card such as the Intel 286/12 Board.

Pattern numbers chosen by the operator using terminal 13 are entered via line 17, into host computer 12 (FIG. 1). Computer 12 loads pattern data from, e.g., pattern computer 14, onto high speed disk 33, and then sends data messages to real-time computer 10. Computer 10, on receipt of such messages, loads the requested pattern data from high speed disk 33 into memory 34. When requested by means of an interrupt, as by the occurrence of a transducer pulse indicating a predetermined length of substrate has passed under the patterning jets, the real-time computer 10 commands the DMA controller 20 to initiate the transfer of the appropriate pattern data stored in memory 34 to the pattern control system 16, via FIFO buffer 28.

A first-in-first-out (FIFO) buffer 28 stores words (16-bits) of pattern data in each buffer location. The pattern data stored in FIFO buffer 28 is then output to the pattern control system 16 along the high-speed (e.g., 2.6 megabytes/second) data bus 22. The FIFO buffer 28 serves as an interface between the rate at which data is placed into the FIFO buffer 28 by DMA processor 32 and the rate at which data is output to the pattern control system 16. If the pattern control system 16 operates at a rate equal to or greater than that of the real-time processor 10, FIFO buffer 28 would not be needed to perform such interface function.

The DMA processor 32 also functions to request memory 34 to provide inputs via line 39 to the 3-bit latch 30 as real-time computer 10 commands it to do so. The latch 30 provides a parallel output on the three channel select lines 24 to the pattern control system 16.

The demultiplexer 42 receives the channel select lines 24 and provides one of eight outputs depending upon the state of the channel select lines 24. The demultiplexer 42 may be any suitable conventional 3-to-8 type demultiplexer.

A portion of the pattern control system 16 is shown in FIG. 4 having a 3:8 demultiplexer 42, a series of 16-bit registers, and a 16-to-8 bit data multiplexer 40. Multiplexer 40 receives the 16-bit words (when either the pattern data select line 34 or the LUT load data select line 47 is selected by the channel select lines 24, through demultiplexer 42) over data bus 22 from the FIFO buffer 28 in the programmable DMA controller board 20. The 16-bit multiplexer 40 then provides single byte (8 bit) write outputs over 8-bit bus 44. Therefore, the data multiplexer 40 serves to convert each 16-bit parallel word into a sequence of two bytes over 8-bit parallel bus 44 for pattern data or LUT load data. The bus 44 is further coupled in parallel with an array of N firing time converters (numbered 1 through N), each firing time converter corresponding to one of N arrays of individual dye jets. Each firing time converter 1 through N includes a plurality of look-up tables (LUT arrays 1 through N) addressed by the contents of the LUT select register 46 which provides the upper address lines to each firing time converter array. Each firing time convertor array may be thought of as a simple, high speed static memory having address lines, data-in lines, data-out lines, and read and write control lines.

Among of the four 16-bit registers loaded by bus 22 is the look-up table (LUT) select register 46. Nine bits from the LUT select register provide the upper nine address lines to each LUT array (1 through N), thus providing 512 LUTs for each respective array. For purposes of discussion, this embodiment is assumed to include 8 color bars (N=8) and, as mentioned above, 512 LUTs per color bar, however, it is understood that different numbers of color bars and LUTs may be used. Each look-up table has a sufficient number of addresses so that each possible address code forming the serial stream of pixel codes may be assigned a unique address in each of the look-up tables. At each address within the look-up table is a byte representing a relative firing time or dye contact time. Assuming an 8 bit address code used to form the raw pixel codes, the firing time can be zero or one of 255 different discrete time values corresponding to the relative amount of time the dye jet in question is to remain "on". Accordingly, for each 8 bit byte of pixel data, one of 256 different firing times (including a firing time of zero) is defined for each specific jet location on each and ever color bar 1–N. Jet identity within a given array is determined by the relative position of the address code within the serial stream of pixel codes and by the information pre-loaded into the look-up table, which information specifies in which arrays a given jet position fires, and for what length of time.

The other three 16-bit registers, SIM DIV 84, TXDCR DIV 86 and MODE REG 88, can be loaded by selecting the appropriate register with the channel select lines and providing the desired value on 16-bit bus 22.

As discussed above, one of the four 16-bit registers loaded by bus 22 is the MODE REGISTER 88. Each of the bits in the mode register specifies a type of operation for the control systems.

The 8-bit bus 44 from Data MUX 40 is connected in parallel to the data inputs of the firing time converters. It is also connected to the input of MUX 48. Connected to the other input of MUX 48 is AUTO address generator 50. Depending on the state of channel select lines 24, one or the other of these inputs can be connected to the lower address lines of each LUT array. To load an array with firing time conversion data, select lines 24 activate the LUT load data select line 47. This "enables" DATA MUX 40, as well as connects AUTO address generator 50 through MUX 48 to the lower address lines of each LUT array in sequence, and provides a sequential "write enable" through sequence 52 to each LUT array such that all data though DATA MUX 40 sequentially loads the specific LUT within each LUT array selected by LUT select register 46 for each LUT array. (The first 256 bytes on bus 44 are loaded into LUT array 1; the second 256 bytes are loaded into LUT array 2, etc.) To output pattern data through the LUT's, select lines 24 activates the pattern data select line 45, which "enables"DATA MUX 40, routes data on bus 44 through MUX 48 to the lower address lines of each LUT array, and provides a "read enable" signal to each LUT array such that data from bus 44 selects the appropriate contents (i.e., firing time) of each LUT selected by the LUT select register 46. This firing time is output on its respective data out bus 55 to each stagger memory array 56. Thus, depending upon the output from channel select lines 24 of the programmable DMA controller 20, the enabling of one of the eight possible output lines from demultiplexer 42 directs where data from BUS 22 will go (i.e., to one of the 16 bit registers, or through MUX 48 to the data inputs of the LUT arrays, or channeled through MUX 48 to the lower address lines of each LUT array).

The firing time information from the LUT arrays comprising firing time converters 1–N is supplied to a respective stagger memory 56 for each of the LUT arrays 1–N. The stagger memories 56 1–N function to compensate for the time necessary for the substrate to be patterned to travel from color bar to color bar due to the physical spacing between the color bars in the jet dyeing apparatus. The stagger memory 56 operates on the firing time data produced by LUT arrays 54 and performs two principal functions: (1) the serial data stream from the LUT array, representing firing times, is grouped and allocated to the appropriate color bars on the patterning machine and (2) "non-operative" data is added to the respective pattern data for each array to inhibit, at start up and for a pre-determined interval which is specific to that particular color bar, the reading of the pattern data in order to compensate for the elapsed time during which the specific portion of the substrate to be patterned with that pattern data is moving from color bar to color bar.

The stagger memories 56 provide their output to a "gatling"memory module 58 for each color bar. The gatling memory 58 performs two principle functions: (1) the serial stream of encoded firing times is converted to individual strings of logical (i.e., "on" or "off") firing commands, the length of each respective "on" string reflecting the value of the corresponding encoded firing time, and (2) these commands are quickly and efficiently allocated to the appropriate dye jets. Thus, the gatling memory arrays serve to distribute the encoded firing times to the appropriate jets for each dye jet color bar such that the desired pattern is produced on the substrate moving under the dye jet color bars. The precise operation of the control system is given below.

Referring to FIG. 5, the control system essentially comprises three separate data storage and allocation systems (a firing time converter, which incorporates the LUT memory, the "stagger" memory, and the "gatling" memory) operating in a serial sequence. These systems are schematically depicted in FIG. 5. FIG. 8 schematically depicts representative data formats at the process stages indicated in FIG. 5.

Each color bar is associated with a respective firing time converter and "stagger" memory, followed by a separate "gatling" memory, arranged in tandem. Each of these major elements will be discussed in turn.

As shown in FIG. 5, the raw pixel codes are sent as prompted by the "start pattern cycle" pulse received from the substrate motion sensor. This sensor merely generates a pulse each time the substrate conveyor moves the substrate a predetermined liner distance (e.g., one-tenth inch) along the path under the patterning color bars. The same "start pattern cycle" pulse is simultaneously sent to each color bar, for reasons which will be explained below.

The raw pixel codes are preferably arranged in strict sequence, with data for applicators 1–480 for the first pattern line being first in the series, followed by data for applicators 1–480 for the second pattern line, etc., as depicted by Data Format B1 of FIG. 8. The complete serial stream of such pixel codes is sent, in identical form and without any color bar-specific allocation, to a firing time converter/memory associated with each respective color bar for conversion of the pixel codes into firing times. This stream of pixel codes preferably comprises a sufficient number of codes to provide an individual code for each dye jet position across the substrate for each pattern line in the overall pattern. Assuming eight color bars of 480 applicators each, a pattern line of 0.1 inch in width (measured along the substrate path), this would require a raw pattern data stream comprised of 288,000 separate codes.

Comprising each firing time converter are the look-up tables described above. The LUT result is sent, in Data Format B2 (see FIG. 8), to the "stagger" memory associated with the given color bar. At this point, no attempt has been made to compensate for the physical spacing between color bars or to group and hold the data for sending to the actual air valves associated with each dye jet.

Compensation for the physical spacing between color bars may be best explained with reference to FIGS. 6A and 6B, which functionally describe the individual stagger memories for various color bars in greater detail.

The "stagger" memory operates as follows. The firing time data is sent to an individual random access memory (RAM) associated with each of the eight color bars. Although either static or dynamic RAM's may be used, static RAM's have been found to be preferred because of increased speed. At each color bar, the data is written to the RAM in the order in which it was sent from the look-up table, thereby preserving the jet and color bar identity of the individual firing times. Each RAM preferably has sufficient capacity to hold firing time information for the total number of patterns lines extending from the first to the eighth color bar (assumed to be seven hundred for purposes of discussion) for each jet in its respective color bar. In the discussion which follows, it may be helpful to consider the seven hundred pattern lines as being arranged in seven groups of one hundred pattern lines each (to correspond with the assumed inter-color bar spacing).

The RAM's are both written to and read from in a unidirectional repeating cycle, with all "read" pointers being collectively initialized and "lock-stepped" so that corresponding address locations in all RAM's for all color bars are read simultaneously. Associated with each RAM is a predetermined offset value which represents the number of sequential memory address values separating the "write" pointer used to insert the data into the memory addresses and the "read" pointer used to read the data from the RAM address, thereby "staggering" in time the respective read and write operations for a given memory address.

As depicted on the left hand side of FIG. 6A, the RAM offset value for the first array is zero, i.e., the "read pattern data" operation is initiated at the same memory address as the "write pattern data" operation, with no offset. The offset for the second color bar, however, is shown as being one hundred, which number is equal to the number of pattern lines or pattern cycles (as well as the corresponding number of read or write cycles) needed to span the distance physically separating the first color bar from the second color bar, as measured along the path of the substrate in units of pattern lines. As depicted, the "read pattern" pointer, initialized at the first memory address location, is found one hundred address locations "above" or "earlier" than the "write" pointer. Accordingly, beginning the "read" operation at a memory address location which lags the "write" operation by one hundred consecutive locations effectively delays the reading of the written data by one hundred pattern cycles to correspond to—and compensate for—the physical spacing between the first and second color bars. To avoid using "dummy" data for the "read" operation until the "read" pointer catches up with the first address written to by the "write" pointer, a "read inhibit" procedure may be used. Such procedure would only be necessary at the beginning and end of a pattern. Alternatively, data representing zero firing time can be loaded into the RAM's in the appropriate address location so that the "read" operation, although enabled, reads data which disables the jets during such times.

The right hand side of FIG. 6A depicts the stagger memory for the eighth color bar. As with all other color bars, the "read" pointer has been initialized to the first memory address in the RAM. The "write" pointer, shown at its initialized memory address location, leads the "read" pointer by an address difference equivalent to seven hundred pattern lines (assuming seven intervening color bars and a uniform inter-color bar spacing of one hundred pattern lines).

FIG. 6B depicts the stagger memories of FIGS. 6A exactly one hundred pattern cycles later, i.e., after the data for one hundred pattern lines have been read. The "read" and "write" pointers associated with color bar 1 are still together, but have moved "down" one hundred memory address locations and are now reading and writing the firing time data associated with the first line of the second group of one hundred pattern lines in the RAM.

The "read" and "write" pointers associated with color 2 are still separated by an offset corresponding to the physical spacing between color bar 1 and color bar 2, as measured in units of pattern lines. Looking at the pointers associated with color bar 8, the "read" pointer is positioned to read the first line of firing time data from the second group of one hundred pattern lines, while the "write" pointer is positioned to write new firing time data into RAM addresses which will be read only after the existing seven hundred pattern lines in the RAM are read. It is therefore apparent the "read" pointer is specifying firing time data which was written seven hundred pattern cycles previously.

The storage registers associated with each color bar's stagger memory store the firing time data for the pattern line to be dyed by that respective color bar in that pattern cycle until prompted by a pulse from the substrate transducer indicating the substrate has traveled a distance equal to the width of one pattern line. At that time, the firing time data is sent to the "gatling" memory for processing as indicated below, and firing time data for the next pattern line is forwarded to the stagger memory for processing as described above.

Associated with each color bar is a set of dedicated first in-first out memory modules (each of which will be hereinafter referred to as a "FIFO"). An essential characteristic of the FIFO is that data is read out of the FIFO in precisely the same order or sequence in which the data was written into the FIFO. The set of FIFO modules must have a collective capacity sufficient to store one byte (i.e., eight bits, equal to the size of the address codes comprising the original pattern data) of data for each of the four hundred eighty diverting air valves in the array. For purposes of explanation, it will be assumed that each of the two FIFO's shown can accommodate two hundred forty bytes of data.

As depicted in FIG. 7, each FIFO has its input connected to the sequential loader and its output connected to an individual comparator. A counter is configured to send an eight bit incrementing count to each of the comparators in response to a pulse from a "gatling" clock. The "gatling"clock is also connected to each FIFO, and can thus synchronize the initiation of operations involving both the FIFO's and the respective comparators associated with each FIFO. If the smallest increment of time on which "firing time" is based is to be different from color bar to color bar, independent clocks and counters may be associated with each such color bar. Preferably, the output from each comparator may be operably connected to a respective shift register/latch combination, which serves to store temporarily the comparator output data before it is sent to the respective color bar, as described in more detail below. Each comparator output is also directed to a common detector, the function of which shall be discussed below. As indicated in FIG. 7, a reset pulse from the detector is sent to both the "gatling" clock and the counter at the conclusion of each pattern cycle, as will be explained below.

In response to the transducer pulse, the respective stagger memories for each color bar are read in sequence and the data is fed to an color bar-specific sequential loader, as depicted in FIG. 7. The sequential loader sends the first group of two hundred forty bytes of data received to a first FIFO and the second group of two hundred forty bytes of data to a second FIFO. Similar operations are performed simultaneously at other sequential loaders associated with other color bars. Each byte represents a relative firing time or dye contact time (or, more accurately, an elapsed diverting air stream interruption time) for an individual jet in the color bar. After each of the FIFO's for each color bar are loaded, they are simultaneously sent a series of pulses from the "gatling" clock, each pulse prompting each FIFO to send a byte of data (comprised of eight bits) in the same sequence in which the bytes were sent to the FIFO by the sequential loader, to its respective individual comparator. This FIFO "firing time" data byte is one of two separate inputs received by the comparator, the second input being a byte sent from a single counter common to all FIFOs associated with every color bar. This common counter byte is sent in response to the same gatling clock pulse which prompted the FIFO data, and serves as a clock for measuring elapsed time from the onset of the dye stream striking the substrate for this pattern cycle. At each pulse from the gatling clock, a new byte of data is released from each FIFO and sent to its respective comparator.

At each comparator, the eight bit "elapsed time" counter value is compared with the value of the eight bit "firing time" byte sent by the FIFO. The result of this comparison is a single "fire/no fire command" bit sent to the shift register as well as the detector. If the FIFO value is greater than the counter value, indicating the desired firing time as specified by the pattern data is greater than the elapsed firing time as specified by the counter, the comparator output bit is a logical "one" (interpreted by the array applicators as a "fire" command). Otherwise, the comparator output bit is a logical "zero" (interpreted by the array applicators as a "no fire" or "cease fire" command). At the next gatling clock pulse, the next byte of firing time data in each FIFO (corresponding to the next individual jet along the array) is sent to the respective comparator, where it is compared with the same counter value. Each comparator compares the value of the firing time data forwarded by its respective FIFO to the value of the counter and generates a "fire/no fire" command in the form of a logical one or logical zero, as appropriate, for transmission to the shift register and the detector.

This process is repeated until all two hundred forty "firing time" bytes have been read from the FIFO's and have been compared with the "elapsed firing time" value indicated by the counter. At this time the shift register, which now contains a serial string of two hundred forty logical ones and zeros corresponding to individual firing commands, forwards these firing commands in parallel format to a latch. The latch serves to transfer, in parallel, the firing commands from the shift register to the individual air valves associated with the color bar dye applicators at the same time the shift register accepts a fresh set of two hundred forty firing commands for subsequent forwarding to the latch. Each time the shift register forwards its contents to the latch (in response to a clock pulse), the counter value is incremented. Following this transfer, the counter value is incremented by one time unit and the process is repeated, with all two hundred forty bytes of "firing time" data in each FIFO being reexamined and transformed into two hundred forty single bit "fire/no fire" commands, in sequence, by the comparator using the newly incremented value of "elapsed time" supplied by the counter.

The above process, involving the sequential comparison of each FIFO's entire capacity of firing time data with each incremented "elapsed time" value generated by the counter, is repeated until the detector determines that all comparator outputs for that color bar are a logical "zero". This indicates that, for all jets in the color bar, no desired firing time (represented by the FIFO values) for any jet in the color bar exceeds the elapsed time then indicated by the counter. When this condition is sensed by the comparator, it indicates that, for that pattern and that color bar, all required patterning has occurred. Accordingly, the detector sends "reset" pulses to both the counter and to the gatling clock. The gatling module then waits for the next substrate transducer pulse to prompt the transmission and loading of firing time data for the next pattern line by the sequential loader into the FIFO's, and the reiterative reading/comparing process is repeated as described above.

A detailed discussion of FIGS. 8 through 14 will follow. These Figures are best understood in the context of the following assumptions. Entry Numbers 1 through 4 will be used to define four separate sets of patterns comprising four sequential print jobs. Entry Numbers 1 and 4 are comprised of a single pattern; Entry Numbers 2 and 3 are each comprised of multiple patterns (for example, 3 and 12, respectively). These entries collectively comprise a run list, which is a sequential arrangement of individual print "jobs" to be executed by the textile printing system described above.

The software system utilizes four separate queues, as follows: (1) a Scheduled Queue for holding, in a desired sequence, Entries (i.e., separate print jobs) to be processed for printing; (2) a Ready Queue for holding, in a desired sequence, Entires that are ready to be printed; (3) a Done Queue for holding, in a desired sequence, Entries that have finished printing; and (4) a Look-Up Table Load Queue for holding, in a desired sequence, Look-Up Tables that need to be loaded into the patterning system to accommodate all patterns in the Ready Queue that are part of Entries that have more than one pattern. Note that the look-up table for Entries that only have one pattern will be loaded into the patterning system on the first line of data for that pattern and thus do not need to be preloaded through the Look-Up Table Load Queue.

The software system keeps track of a set of variables for each pattern (and therefore for each look-up table) in each Entry as follows: (1) MODE, which can equal one of four states: (a) scheduled, (b) queued, (c) loaded, or (d) complete; (2) LOADED, a binary flag which indicates that the look-up table for that pattern has been loaded into the patterning system; (3) LOADING, a binary flag which indicates that the software system is currently trying to load the look-up table into the patterning system; (4) NEEDS LOADING, a binary flag which indicates that the look-up table needs to be loaded into the patterning system; and (5) LUT #, which identifies the destination in the patterning system into which this look-up table will be loaded.

The software system keeps track of one binary flag, named LUT IS LOADING, which indicates that the software system is currently trying to load a look-up table into the patterning system. Another variable, named SAMPLE LUT #, keeps track of the next look-up table in the patterning system available to the software system.

The software system is broken up into four processes as follows: (1) ADD ENTRY TO RUN LIST, (2) PREPARE ENTRY FOR RUNNING, (3) TRANSDUCER PROCESS, and (4) CHANGE FIRING TIME. These four processes are diagrammatically depicted in FIGS. 8 through 14 as flow charts, and will be discussed in turn below.

Referring to FIG. 8, ADD ENTRY TO RUN LIST is a program used to add an Entry (i.e., a print job) to the Scheduled Queue. The program starts at 200, then proceeds to 210 to wait for an Entry to be scheduled by the operator. When an Entry is scheduled the program moves to 212 and sets MODE for all patterns in the Entry to scheduled. Next, the Entry is put into the Scheduled Queue at 214. The software then returns to 210 to wait for the next Entry.

Referring to FIG. 9, PREPARE ENTRY FOR RUNNING is a program used to prepare all Entries for insertion into the Ready Queue. SAMPLE LUT # is initialized at 218. The program waits for an Entry to appear in the Scheduled Queue at 220. Upon receiving an Entry from the Schedule Queue (222), the program proceeds to specify, for each pattern contained in the Entry, values for MODE, LOADED, LOADING, and NEEDS LOADING (at 224). If the Entry contains only one pattern (at 226), LUT # is set to zero. This specific LUT # is reserved for Entries which contain only a single pattern, and allow the software system to load the respective look-up table immediately before the first line of pattern data is processed by the patterning system.

If the Entry contains more than one pattern, the following occurs for each pattern in the Entry (230): (1) the LUT # is set to equal SAMPLE LUT #; (2) SAMPLE LUT # is incremented by one, divided by (MAX LUTs−1), and the remainder taken. (MAX LUTs−1, instead of MAX LUTs, is taken only if it is desired to reserve the last look-up table for other a purposes.) SAMPLE LUT # is made equal to the remainder. If SAMPLE LUT # is equal to zero, it is made equal to one.

This skips look-up table zero which is reserved for Entries which have only one pattern; (3) the look-up table for this pattern is put into the Look-Up Table Load Queue.

Following the outcome of decision 226 (i.e., determination of whether Entry has one pattern), the Entry is put in the Ready Queue (232), and the system resumes waiting on the next Entry from the Scheduled Queue (220).

Turning now to FIGS. 10A and 10B, the process by which the system control software generates commands for the Direct Memory Access controller (and instructs the DMA controller to carry out those commands) to output data to the patterning system, will be described as it pertains to the instant invention. LUT IS LOADING flag is set to false (242) to indicate that the system is not currently trying to load a look-up table. The software then gets the first available Entry from the Ready Queue (244). The system then determines if the "current" Entry (i.e., the Entry being patterned at this time) is completed (246).

If yes, then the system determines if that Entry is comprised of a single pattern (248). If yes, then the system checks to see if the current look-up table that is being loaded is the look-up table of this pattern (250). If yes, the LUT IS LOADING flag is set to false (254) and the MODE variable is set to complete (260). If the current look-up table that is being loaded is not the look-up table of this pattern, the system proceeds directly to 260 and the MODE variable is set to complete. The system then places the Entry into the Done Queue (262) and gets the next available Entry from the Ready Queue (274). The system then proceeds to 276, which will be described below.

Looking again at decision 248, if the Entry is comprised of multiple patterns, the system starts with the first pattern of the Entry (252) and determines if MODE =queued (256). If yes, the look-up table is removed from the Look-Up Table Load Queue (258), and the system proceeds to decision 264. If no, the system goes directly to decision 264, at which the system determines if the look-up table that is currently being loaded is this pattern's look-up table. If yes, the LUT IS LOADING flag is set to false (266) and the MODE variable is set to complete (268). If the current look-up table that is being loaded is not the look-up table of this pattern, the system proceeds directly to 268 and the MODE variable is set to complete. The system then determines if all patterns for this Entry have been processed (270). If not, the system proceeds to the next pattern (272) and returns to decision 256, described above. If all patterns in this Entry have been processed (270), the system proceeds to put the Entry into the Done Queue (262) and gets the next available Entry from the Ready Queue (274). The system then proceeds to 276, which will be described below.

Referring again to decision 246, if the current Entry is not completed, the system proceeds to decision 276 to determine whether the current Entry is comprised of a single pattern. If the current entry is comprised of multiple patterns, the system determines if the LOADED flag is true for all patterns in the Entry (278). If yes, the system generates Direct Memory Access commands to output the next line of data for the multiple pattern Entry (500), described below in reference to FIG. 12. If no, the system generates Direct Memory Access commands to output a line of nulls, i.e., instructions that prevent the dye jets from applying dye to the substrate (600), described below in reference to FIG. 13. This condition causes unintentionally unpatterned substrate to be generated by the patterning system, an undesirable condition that this software system is designed to minimize. (This software should cause decision 278 to always yield "yes" because all look-up tables for multiple pattern Entries are pre-loaded during prior Entries, before they are needed.)

Referring again to decision 276, if the Entry is comprised of a single pattern, the system generates Direct Memory Access commands to output the next line of data for the single pattern Entry (400), described below in reference to FIG. 11.

Processing blocks 400, 500, and 600 all exit to 280, where the system waits for the next transducer pulse to occur (indicating that a predetermined length of substrate has passed through the patterning device and the next line of pattern data should be sent to the patterning jets). Upon sensing the next transducer pulse, the system instructs the Direct Memory Access controller to execute the previously set up Direct Memory Access commands (282).

The next section of system logic depicted in FIG. 10B is intended to confirm the loading of the look-up table on the previous Direct Memory Access command for the previous line of data. Decision 284 determines the existence of an error in the loading process. If yes, then the flag LUT IS LOADING is tested (292). If true (i.e., a look-up table was loading on the previous line of data), then the respective look-up table's LOADING flag is set to false (294), the NEEDS LOADING flag is set to true (296), and the system returns to decision 246, described above.

If the outcome of decision 292 is false (i.e., no look-up table was loading on the previous line of data), then the system returns to decision 246, described above.

Referring again to decision 284, if no errors were detected in the loading process, then the flag LUT IS LOADING is tested (286). If false (i.e., no look-up table was loading on the previous line of data), then the system returns to decision 246, described above. If true (i.e., a look-up table was loading on the previous line of data), then the LOADING flag for the look-up table that was loading is tested (288). If false (i.e., the look-up table was in the process of being loaded but not on the previous line because a single pattern Entry's look-up table had to be loaded), then the system returns to decision 246, described above. If true, then the system sets the respective look-up table's LOADING flag to false, the NEEDS LOADING flag to false, the LOADED flag to true, and the global flag LUT IS LOADING to false (290), and returns to decision 246, described above.

If the current Entry is comprised of a single pattern at decision 276, the system generates Direct Memory Access commands to output the next line of data for the single pattern Entry (400), as shown in FIG. 11. The system determines if the current line of data is the first line of data for this Entry. If yes, then MODE is set to loaded (456), LOADED is set to true (458), and commands for the Direct Memory Access controller are generated to load this look-up table (460). The system then proceeds to 452, where commands for the Direct Memory Access controller are generated to output the current line of data for this single pattern Entry.

If the system determines (at 412) that the line of pattern data is not the first line of pattern data for this Entry, then the system checks the LUT IS LOADING flag (to determine if a look-up table is loading) (420). If yes, then the respective look-up table's LOADING flag is set to true (422) and NEEDS LOADING flag is set to false (424). The system then generates commands for the Direct Memory Access controller to load this look-up table (450). The system then proceeds to 452, where commands for the Direct Memory Access controller are generated to output the current line of data for this single pattern Entry.

Referring back to decision 420, if LUT IS LOADING flag is false, then the system determines if the current Entry has only one pattern and its look-up table's MODE equals queued. If yes, then the respective look-up table's MODE is set to loaded, LOADING flag is set to true, and NEEDS LOADING flag is set to false (428). The system then generates commands for the Direct Memory Access controller to load this look-up table (450). The system then proceeds to 452, where commands for the Direct Memory Access controller are generated to output the current line of data for this single pattern Entry.

Referring back to decision 426, unless the current Entry is comprised of a single pattern and the MODE variable equals queued, the system determines whether the Look-Up Table Load Queue is empty (430). If yes, the system then proceeds to 452, where commands for the Direct Memory Access controller are generated to output the current line of data for this single pattern Entry. If no, the system retrieves the next available look-up table from the Look-Up Table Load Queue (432), and sets MODE equal to loaded, LOADING flag to true, and NEEDS LOADING flag to false (434). The system then generates commands for the Direct Memory Access controller to load this look-up table (450). The system then proceeds to 452, where commands for the Direct Memory Access controller are generated to output the current line of data for this single pattern Entry.

If the LOADED flag is true for all patterns in the current Entry at decision 278, the system generates Direct Memory Access commands to output the next line of data for the multiple pattern Entry (500), as shown in FIG. 12. The system checks the LUT IS LOADING flag (to determine if a look-up table is loading) (520). If yes, then the respective look-up table's LOADING flag is set to true (522) and NEEDS LOADING flag is set to false (524). The system then generates commands for the Direct Memory Access controller to load this look-up table (550). The system then proceeds to 552, where commands for the Direct Memory Access controller are generated to output the current line of data for this multiple pattern Entry.

Referring back to decision 520, if LUT IS LOADING flag is false, then the system determines if the current Entry has only one pattern and its look-up table's MODE equals queued. loaded, LOADING flag is set to true, and NEEDS LOADING flag is set to false (528). The system then generates commands for the Direct Memory Access controller to load this look-up table (550). The system then proceeds to 552, where commands for the Direct Memory Access controller are generated to output the current line of data for this multiple pattern Entry.

Referring back to decision 526, unless the current Entry is comprised of a single pattern and the MODE variable equals queued, the system determines whether the Look-Up Table Load Queue is empty (530). If yes, the system then proceeds to 552, where commands for the Direct Memory Access controller are generated to output the current line of data for this multiple pattern Entry. If no, the system retrieves the next available look-up table from the Look-Up Table Load Queue (532), and sets MODE equal to loaded, LOADING flag to true, and NEEDS LOADING flag to false (534). The system then generates commands for the Direct Memory Access controller to load this look-up table (550). The system then proceeds to 552, where commands for the Direct Memory Access controller are generated to output the current line of data for this multiple pattern Entry.

If the LOADED flag is not true for all patterns in the current Entry at decision 278, the system generates Direct Memory Access commands to output a line of nulls (i.e., instructions that prevent the dye jets from applying dye to the substrate) (600), as shown in FIG. 13. The system checks the LUT IS LOADING flag (to determine if a look-up table is loading) (620). If yes, then the respective look-up table's LOADING flag is set to true (622) and NEEDS LOADING flag is set to false (624). The system then generates commands for the Direct Memory Access controller to load this look-up table (650). The system then proceeds to 652, where commands for the Direct Memory Access controller are generated to output a line of nulls.

Referring back to decision 620, if LUT IS LOADING flag is false, then the system determines if the current Entry has only one pattern and its look-up table's MODE equals queued. If yes, then the respective look-up table's MODE is set to loaded, LOADING flag is set to true, and NEEDS LOADING flag is set to false (628). The system then generates commands for the Direct Memory Access controller to load this look-up table (650). The system then proceeds to 652, where commands for the Direct Memory Access controller are generated to output a line of nulls.

Referring back to decision 626, unless the current Entry is comprised of a single pattern and the MODE variable equals queued, the system determines whether the Look-Up Table Load Queue is empty (630). If yes, the system then proceeds to 652, where commands for the Direct Memory Access controller are generated to output the current line of data for this multiple pattern Entry. If no, the system retrieves the next available look-up table from the Look-Up Table Load Queue (632), and sets MODE equal to loaded, LOADING flag to true, and NEEDS LOADING flag to false (634). The system then generates commands for the Direct Memory Access controller to load this look-up table (650). The system then proceeds to 652, where commands for the Direct Memory Access controller are generated to output a line of nulls. When it is necessary to adjust the firing times assigned to the individual jets for a given pattern element, a new Look-Up Table must be loaded into the patterning system for each affected pattern. The system accommodates this situation by means of the logic set forth in FIG. 14. Upon sensing that the firing time contained in a look-up table is to be changed (300), the system updates the affected look up table (or tables, in the case of a multiple pattern Entry) in the real time computer memory (302).

The system determines if the Entry containing the affected look-up table (or tables) is comprised of a single pattern (304). If yes, then the MODE variable is tested to determine if it equals loaded (306). If yes, then the MODE variable is set to queued. This will cause the look-up table to be reloaded. (If MODE is set to queued, then the decisions at 426, 526, or 626 will result in a yes, which will cause the look-up table to be reloaded at 450, 550, or 650). The system then returns to 300 to await the next indicated change in firing time. If the decision at 30 is no, then the system returns to 300 to await the next indicated change in firing time.

If the Entry is comprised of multiple patterns, i.e., the decision at 304 is no, then the system starts with the first pattern of the Entry (310) and determines if MODE equals loaded (312). If yes, then MODE is set to queued (314) and the look-up table is placed at the top of the Look-Up Table Load Queue (316), and proceeds to decision 318, described below. This causes the look-up table to be the next in line for loading. If MODE is not equal to loaded, the system proceeds to decision 318.

The system then determines if all patterns for this Entry have been processed (318). If not, then the system proceeds to the next pattern (320) and returns to decision 312, described above. If all patterns in this Entry have been processed (318), the system returns to 300 to await the next indicated change in firing time.

I claim:

1. A method for processing digitally encoded pattern information for use in a patterning method wherein a plurality of arrays are spaced across the path of a moving substrate to be patterned, each of said arrays comprising a plurality of individually addressable dye applicators capable of selectively projecting a stream of dye onto a predetermined portion of the substrate corresponding to an individual pattern element comprising said pattern, said device capable of applying multiple pattern sets in sequence to a relatively moving substrate, each pattern set being comprised of at least one pattern having printing characteristics in association therewith, said method utilizing an electronic control system, said control system being comprised of an electronic computer having a first memory and a second memory, wherein data is transferred from said first memory to said second memory, said method further comprising:

a. accessing the first pattern set;

b. providing a second memory, said second memory comprised of a plurality of look-up tables, said look-up tables requiring loading for each of said patterns to be applied to said substrate;

d. scheduling a pattern set by placing the pattern set into a scheduled queue;

e. preparing said pattern set for printing by queuing each of said look-up tables for each pattern to be loaded from said first memory to said second memory such that each of said look-up tables are loaded in sequence before patterns associated with said respective look-up tables are applied to said substrate;

f. generating and issuing direct memory access commands to transfer said pattern look-up tables from said first memory to said second memory during the process of applying previous patterns from those queued to run at a later time such that queued look-up tables are loaded in the correct sequence and prior to being needed; and g. re-queuing look-up tables to be transferred from said first memory to said second memory in a priority manner such as to load said look-up tables during running of their respective pattern to provide for the timely and efficient updating of said printing characteristics of said pattern as necessary.

2. A method according to claim 1, wherein said step of accessing the first pattern set is accomplished by means of utilizing a high speed disk connected to said first memory by a bus.

3. A method according to claim 2, wherein said step of accessing the first pattern set is accomplished by means of utilizing a pattern computer coupled to said high speed disk.

4. A method according to claim 1, wherein said step of scheduling a pattern set by placing the pattern set into a scheduled queue further comprises waiting for a pattern set, marking said pattern set as scheduled prior to the step of placing the pattern set into a queue.

5. A method according to claim 1, wherein said step of preparing said pattern set for printing by queuing further comprises indicating said pattern set as queued, not loaded, not loading and in need of loading.

6. A method according to claim 5, wherein said step of preparing said pattern set for printing by queuing and indicating said pattern set as queued, not loaded, not loading and in need of loading further comprises a later step of indicating said pattern set as loading.

7. A method according to claim 1, wherein said step of generating and issuing direct memory access commands to transfer said pattern look-up tables from said first memory to said second memory during the process of applying previous patterns from those queued to run at a later time such that queued look-up tables are loaded in the correct sequence and prior to being needed further comprises waiting for a transducer pulse prior to transferring a line of pattern data.

8. A method according to claim 1, wherein said step of generating and issuing direct memory access commands to transfer said pattern look-up tables from said first memory to said second memory during the process of applying previous patterns from those queued to run at a later time such that queued look-up tables are loaded in the correct sequence and prior to being needed further comprises a later step of indicating said pattern set as loaded.

9. A method according to claim 1, wherein said step of generating and issuing direct memory access commands to transfer said pattern look-up tables from said first memory to said second memory during the process of applying previous patterns from those queued to run at a later time such that queued look-up tables are loaded in the correct sequence and prior to being needed further comprises a later step of indicating said pattern set as loaded, loading and not in need of loading.

10. A method according to claim 1, wherein said step of generating and issuing direct memory access commands to transfer said pattern look-up tables from said first memory to said second memory during the process of applying previous patterns from those queued to run at a later time such that queued look-up tables are loaded in the correct sequence and prior to being needed further comprises a line of nulls being transferred if all pattern sets do not have a loaded indication.

11. A method according to claim 1, wherein said step of re-queuing look-up tables to be transferred from said first memory to said second memory in a priority manner such as to load said look-up tables during running of their respective pattern to provide for the timely and efficient updating of said pattern's printing characteristics as necessary further comprises a later step of determining whether said pattern set is indicating a loaded state.

* * * * *